US011725364B2

(12) United States Patent
Fukuda et al.

(10) Patent No.: US 11,725,364 B2
(45) Date of Patent: Aug. 15, 2023

(54) HYDRAULIC SYSTEM OF WORKING MACHINE

(71) Applicant: KUBOTA CORPORATION, Osaka (JP)

(72) Inventors: Yuji Fukuda, Sakai (JP); Jun Tomita, Sakai (JP); Yuya Konishi, Sakai (JP); Toshiya Tani, Sakai (JP); Daisuke Sakurai, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/830,473

(22) Filed: Jun. 2, 2022

(65) Prior Publication Data

US 2022/0389680 A1 Dec. 8, 2022

(30) Foreign Application Priority Data

Jun. 4, 2021 (JP) ..... 2021-094550

(51) Int. Cl.
*E02F 9/22* (2006.01)
*F15B 21/0427* (2019.01)
*F15B 13/02* (2006.01)

(52) U.S. Cl.
CPC ..... *E02F 9/2228* (2013.01); *E02F 9/2242* (2013.01); *E02F 9/2253* (2013.01); *E02F 9/2267* (2013.01); *E02F 9/2285* (2013.01); *F15B 13/02* (2013.01); *F15B 21/0427* (2019.01); *E02F 9/2292* (2013.01); *E02F 9/2296* (2013.01); *F15B 2211/20576* (2013.01)

(58) Field of Classification Search
CPC ..... E02F 9/2228; E02F 9/2242; E02F 9/2253; E02F 9/2267; E02F 9/2285; E02F 9/2292; E02F 9/2296; F15B 11/17; F15B 21/042; F15B 21/0427
See application file for complete search history.

(56) References Cited

U.S. PATENT DOCUMENTS

| | | | | |
|---|---|---|---|---|
| 9,316,310 | B2 * | 4/2016 | Kinugawa | F16H 61/468 |
| 10,316,496 | B2 * | 6/2019 | Fukuda | E02F 9/2228 |
| 10,711,438 | B2 * | 7/2020 | Fukuda | E02F 9/2253 |
| 10,767,346 | B2 * | 9/2020 | Honda | E02F 9/2289 |
| 10,920,881 | B2 * | 2/2021 | Fukuda | E02F 9/226 |
| 10,941,793 | B2 * | 3/2021 | Fukuda | E02F 9/2271 |

FOREIGN PATENT DOCUMENTS

JP 5809544 B2 11/2015

* cited by examiner

*Primary Examiner* — Michael Leslie
(74) *Attorney, Agent, or Firm* — Keating and Bennett, LLP

(57) ABSTRACT

A hydraulic system of a working machine includes a hydraulic pump to output a hydraulic fluid, at least one proportional valve to deliver the hydraulic fluid to a supply target, a valve body including the proportional valve, a heat-up fluid passage in the valve body and into which the hydraulic fluid flows, a switching valve switchable between an open position in which the hydraulic fluid passing through the heat-up fluid passage is supplied to a hydraulic device and a closed position in which the hydraulic fluid is not supplied thereto and the hydraulic fluid from the hydraulic device is to be returned, a controller to operate the switching and proportional valves, and a return circuit through which the hydraulic fluid flowing into the heat-up fluid passage is returned as a result of at least one of the switching and proportional valves being operated by the controller.

12 Claims, 20 Drawing Sheets

HYDRAULIC SYSTEM OF WORKING MACHINE

CROSS REFERENCE TO RELATED APPLICATIONS

This application claims the benefit of priority to Japanese Patent Application No. 2021-094550 filed on Jun. 4, 2021. The entire contents of this application are hereby incorporated herein by reference.

BACKGROUND OF THE INVENTION

1. Field of the Invention

The present invention relates to a hydraulic system of a working machine, such as a skid-steer loader, a compact track loader, or a backhoe.

2. Description of the Related Art

In the related art, the hydraulic system of the working machine disclosed in Japanese Patent No. 5809544 is commonly known.

The hydraulic system disclosed in Japanese Patent No. 5809544 includes a hydraulic pump that takes in a hydraulic fluid retained in a hydraulic fluid tank and outputs the hydraulic fluid, a proportional valve that delivers the hydraulic fluid output from the hydraulic pump to a supply target, and a valve body including the proportional valve.

In Japanese Patent No. 5809544, the valve body is provided with a heat-up fluid passage into which the hydraulic fluid output from the hydraulic pump flows, and a passage through which the hydraulic fluid flowing out from the heat-up fluid passage flows into the hydraulic fluid tank is provided with a heat-up relief valve. The hydraulic fluid flowing into the heat-up fluid passage via the heat-up relief valve flows into the hydraulic fluid tank, thereby heating up the valve body (i.e., the proportional valve).

SUMMARY OF THE INVENTION

In the hydraulic system disclosed in Japanese Patent No. 5809544, the set pressure of the heat-up relief valve relative to the set pressure of a main relief valve that sets the pressure of the hydraulic fluid output from the hydraulic pump is set such that the heat-up relief valve opens when the hydraulic fluid is at a low temperature and closes when the hydraulic fluid reaches a predetermined temperature or higher. In other words, the set pressure of the heat-up relief valve relative to the set pressure of the main relief valve is set such that the hydraulic fluid within the heat-up fluid passage can be discharged only when the proportional valve needs to be heated up. However, this setting is difficult, and the hydraulic fluid may sometimes be discharged from the heat-up relief valve when a heat-up operation is not necessary.

Preferred embodiments of the present invention provide hydraulic systems of working machines that each can reliably control the discharge of a hydraulic fluid from within a heat-up fluid passage during a heat-up operation.

A hydraulic system of a working machine according to an aspect of a preferred embodiment of the present invention includes a hydraulic pump to output a hydraulic fluid, at least one proportional valve to deliver the hydraulic fluid output from the hydraulic pump to a supply target, a valve body that includes the proportional valve, a heat-up fluid passage that is provided in the valve body and into which the hydraulic fluid output from the hydraulic pump flows, at least one switching valve switchable between an open position in which the hydraulic fluid having passed through the heat-up fluid passage is supplied therethrough to a hydraulic device and a closed position in which the hydraulic fluid having passed through the heat-up fluid passage is not supplied therethrough to the hydraulic device and the hydraulic fluid from the hydraulic device is allowed to flow therethrough to be returned, a controller configured or programmed to operate the switching valve and the proportional valve, and a return circuit through which the hydraulic fluid having flown into the heat-up fluid passage is returned as a result of at least one of the switching valve and the proportional valve being operated by the controller.

The hydraulic system of the working machine may further include a first hydraulic device defining the hydraulic device to be supplied with the hydraulic fluid via a first switching valve of a plurality of the switching valves including the first switching valve and a second switching valve, a first fluid passage that connects the first hydraulic device and the first switching valve to each other, a second hydraulic device defining the hydraulic device to be supplied with the hydraulic fluid via the second switching valve, and a second fluid passage that connects the second hydraulic device and the second switching valve to each other. The return circuit may include a connection circuit that connects the first fluid passage and the second fluid passage to each other. The hydraulic fluid from the heat-up fluid passage may be returned through the return circuit via the first fluid passage, the connection circuit, the second fluid passage, and the second switching valve as a result of the first switching valve being operated to the open position by the controller in a state where the second switching valve is in the closed position.

The hydraulic system of the working machine may further include a second-speed switching valve to switch a traveling device, which is speed-changeable between two high and low speed modes, to a second speed mode, a brake release valve to release a braking force applied to the traveling device, and a work lock valve to set a work operation device, which operates a working device, in a non-operable mode. The first switching valve may be any one of the second-speed switching valve, the brake release valve, and the work lock valve. The second switching valve may be any remaining one of the second-speed switching valve, the brake release valve, and the work lock valve other than the first switching valve.

The hydraulic system of the working machine may further include a supply fluid passage to supply the hydraulic fluid from the proportional valve to the supply target. The proportional valve, when opened to have an opening adjusted to set a set pressure of the proportional valve, may output the hydraulic fluid having the set pressure to the supply target, and, when closed, may allow the hydraulic fluid from the supply fluid passage to flow therethrough to be returned. The return circuit may include a connection circuit that connects the supply fluid passage to a hydraulic-device fluid passage to supply the hydraulic fluid from the switching valve to the hydraulic device. The hydraulic fluid from the heat-up fluid passage may be returned through the return circuit via the fluid passage, the connection circuit, the supply fluid passage, and the proportional valve as a result of the switching valve being operated to the open position by the controller in a state where the proportional valve is closed.

Furthermore, a set pressure of the switching valve may be higher than the set pressure of the proportional valve.

The hydraulic system of the working machine may further include a supply fluid passage to supply the hydraulic fluid flowing through the heat-up fluid passage from the proportional valve to the supply target. The proportional valve, when opened to have an opening adjusted to set a set pressure of the proportional valve, may output the hydraulic fluid having the set pressure to the supply target, and, when closed, may allow the hydraulic fluid from the supply fluid passage to flow therethrough to be returned. The return circuit may include a connection circuit that connects the supply fluid passage to a hydraulic-device fluid passage to supply the hydraulic fluid from the switching valve to the hydraulic device. The hydraulic fluid flowing in from the heat-up fluid passage may be returned through the return circuit via the proportional valve, the supply fluid passage, the connection circuit, the hydraulic-device fluid passage, and the switching valve as a result of the proportional valve being opened by the controller in a state where the switching valve is in the closed position.

Furthermore, the set pressure of the proportional valve may be higher than a set pressure of the switching valve.

The hydraulic system of the working machine may further include a third hydraulic device defining the hydraulic device to be supplied with the hydraulic fluid via a third switching valve of a plurality of the switching valves including the third switching valve and a fourth switching valve, a third fluid passage that connects the third hydraulic device and the third switching valve to each other, a fourth hydraulic device defining the hydraulic device to be supplied with the hydraulic fluid via the fourth switching valve, a fourth fluid passage that connects the fourth hydraulic device and the fourth switching valve to each other, and a supply fluid passage to supply the hydraulic fluid flowing through the heat-up fluid passage from the proportional valve to the supply target. The proportional valve, when opened to have an opening adjusted to set a set pressure of the proportional valve, may output the hydraulic fluid having the set pressure to the supply target, and, when closed, may allow the hydraulic fluid from the supply fluid passage to flow therethrough to be returned. The return circuit may include a bleed circuit that is connected to the third fluid passage and through which the hydraulic fluid from the heat-up fluid passage is returned from the third fluid passage via a throttle, and may also include a connection circuit that connects the fourth fluid passage and the supply fluid passage to each other. The hydraulic fluid having flown into the heat-up fluid passage may be returned through the return circuit via the bleed circuit, the proportional valve, the supply fluid passage, the connection circuit, the fourth fluid passage, and the fourth switching valve as a result of the third switching valve being operated by the controller to the open position and the proportional valve being opened by the controller in a state where the fourth switching valve is in the closed position.

Furthermore, the set pressure of the proportional valve may be higher than a set pressure of the fourth switching valve.

Moreover, the at least one proportional valve may include a plurality of proportional valves. The plurality of proportional valves may be arranged in sequence from upstream toward downstream of the heat-up fluid passage and may each be supplied with the hydraulic fluid from the heat-up fluid passage. The proportional valve to supply the hydraulic fluid to the supply target through the supply fluid passage may be located at a downstream-most location of the heat-up fluid passage.

The hydraulic system of the working machine may further include a traveling device, a hydraulic drive to hydraulically drive the traveling device, and a travel operation device to pilot-operate the hydraulic driving device. The proportional valve may be a traveling pressure control valve to supply the hydraulic fluid to the travel operation device defining the supply target.

Furthermore, the return circuit may include a bleed circuit that is connected to a hydraulic-device fluid passage to supply the hydraulic fluid to the hydraulic device from the switching valve and through which the hydraulic fluid is returned from the hydraulic-device fluid passage via a throttle as a result of the switching valve being operated to the open position by the controller.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
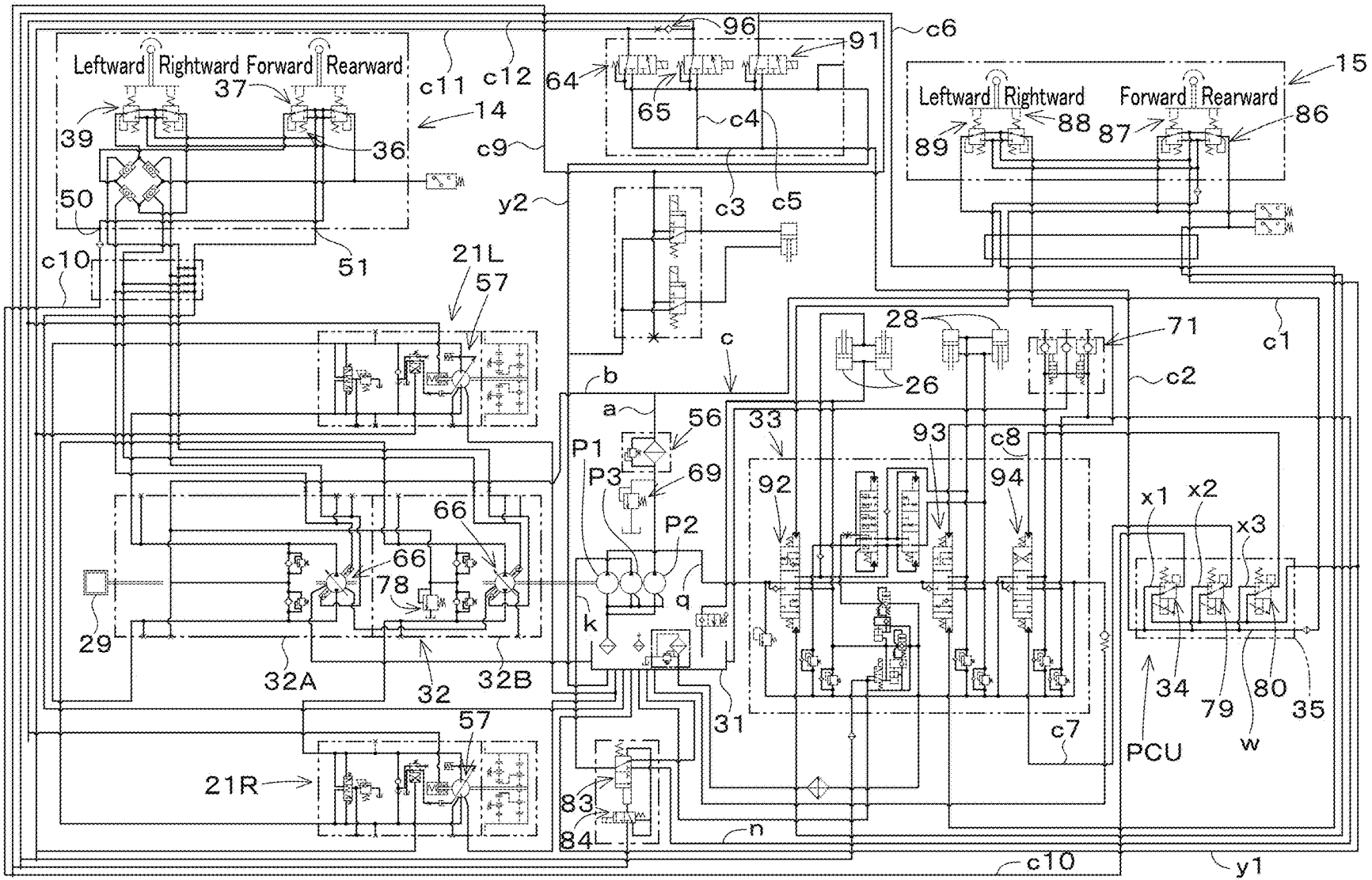
FIG. 1 illustrates a hydraulic circuit in a hydraulic system of a working machine.

The preferred embodiments will now be described with reference to the accompanying drawings, wherein like reference numerals designate corresponding or identical elements throughout the various drawings. The drawings are to be viewed in an orientation in which the reference numerals are viewed correctly.

Preferred embodiments of the present invention will be described below with reference to the drawings, where appropriate.

Figure 13:
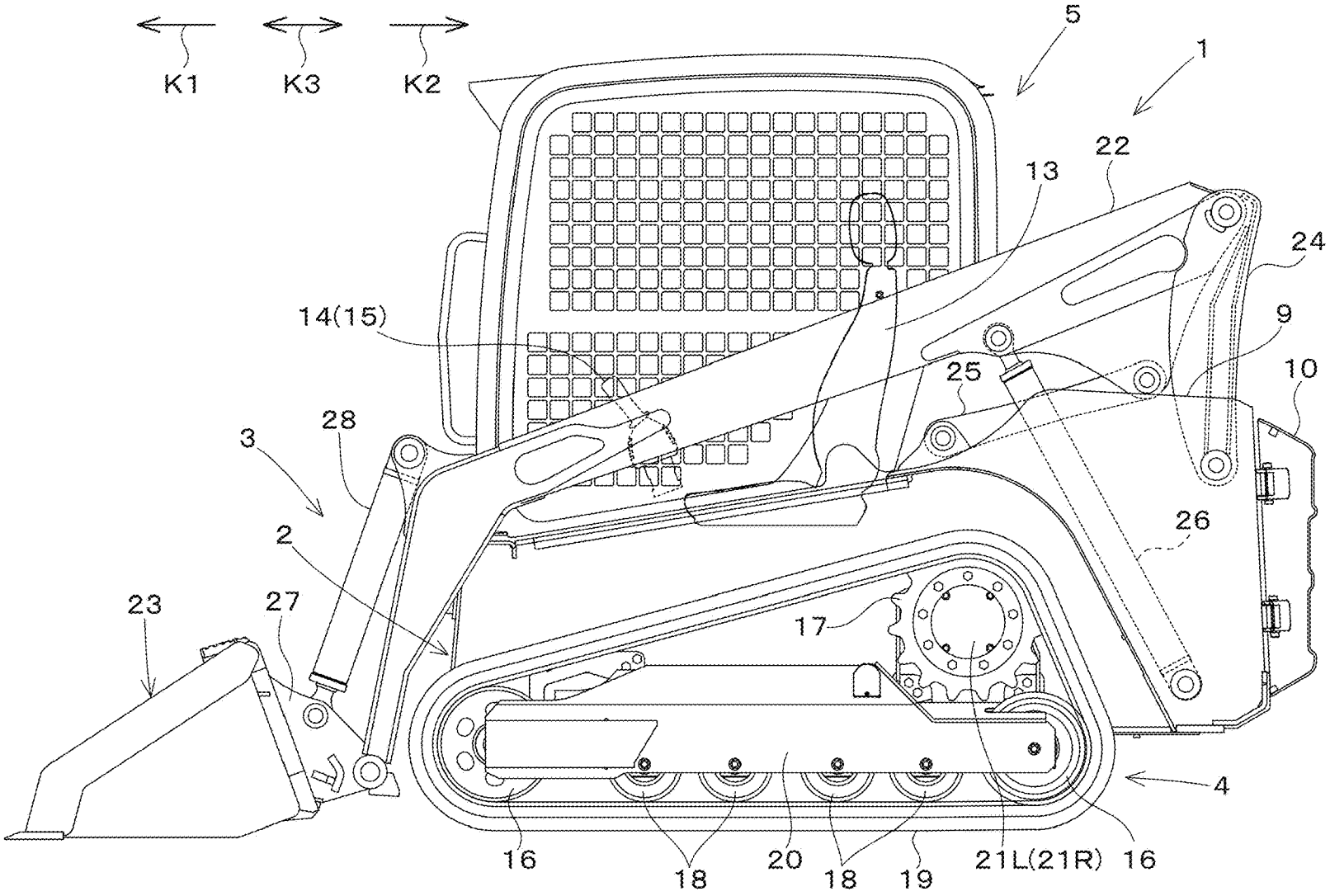
FIG. 13 is an overall side view of a working machine.
Figure 14:
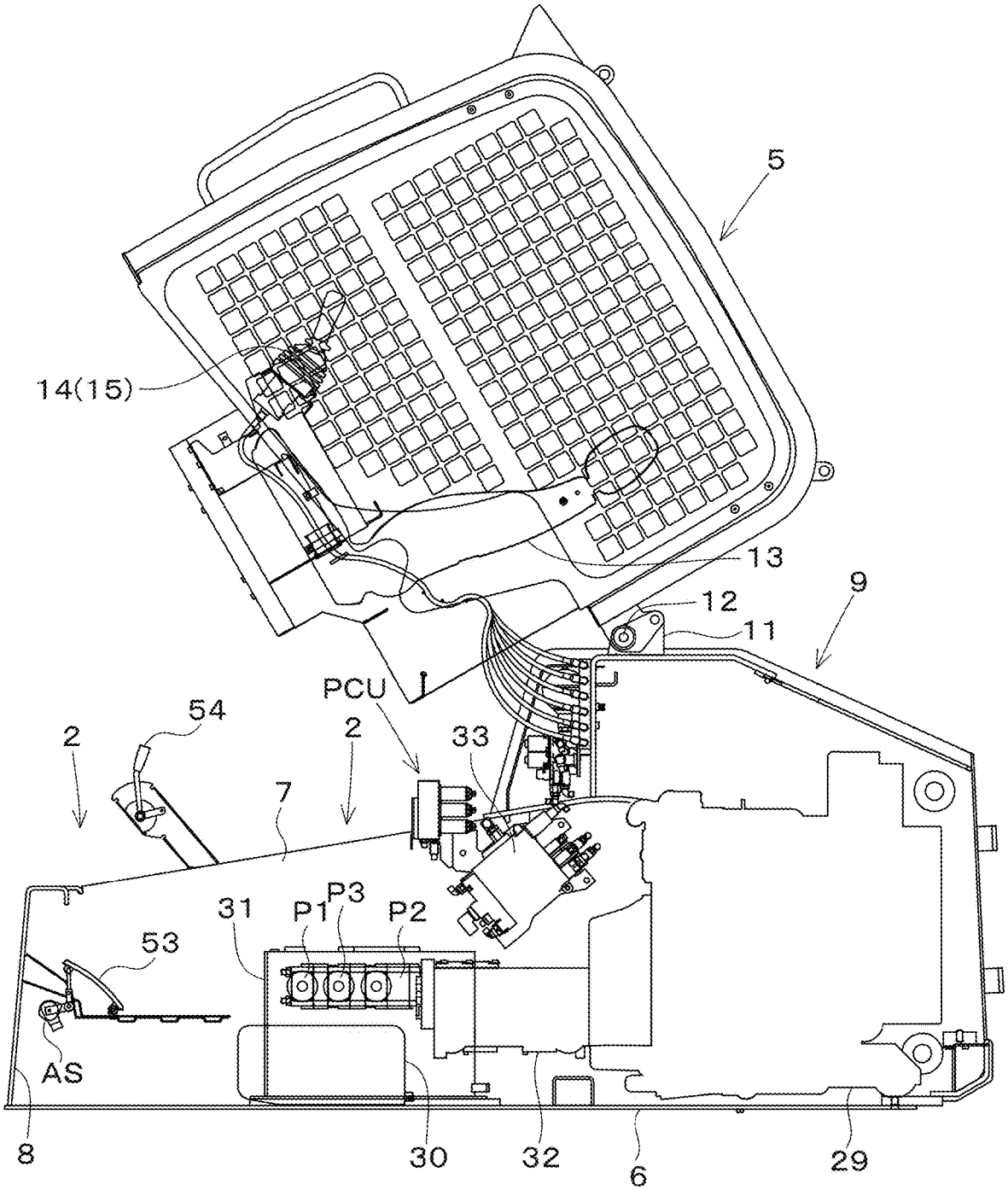
FIG. 14 is a side view illustrating a portion of the working machine in a state where a cabin is raised.

FIG. 13 and FIG. 14 illustrate a working machine 1 including a hydraulic system according to the present preferred embodiment. In this preferred embodiment, a compact track loader is illustrated as an example of the working machine 1. However, the working machine 1 is not limited to a compact track loader and may be, for example, another type of a loader working machine, such as a skid-steer loader. Moreover, the working machine 1 may be a working machine other than a loader working machine.

As illustrated in FIG. 13, the working machine 1 includes a machine body 2, a working device 3 attached to the machine body 2, and traveling devices 4 that support the machine body 2 in a travelable manner. Furthermore, a cabin 5 (i.e., an operator protector) that encompasses an operator's seat 13 is provided toward the front of an upper portion of the machine body 2.

In this preferred embodiment, a direction (indicated by an arrow K1 in FIG. 13) extending forward from an operator sitting in the operator's seat 13 of the working machine 1 will be described as a forward direction (i.e., a machine-body forward direction), and a direction (indicated by an arrow K2 in FIG. 13) extending rearward from the operator will be described as a rearward direction (i.e., a machine-body rearward direction). Therefore, a direction indicated by an arrow K3 in FIG. 13 is a front-rear direction (i.e., a machine-body front-rear direction). Furthermore, a direction extending leftward from the operator will be described as a leftward direction (i.e., the near side in FIG. 13), and a direction extending rightward from the operator will be described as a rightward direction (i.e., the far side in FIG. 13).

Moreover, a horizontal direction extending orthogonally to the front-rear direction (i.e., a machine-body front-rear direction) K3 will be described as a machine-body width direction. Furthermore, a direction extending rightward or leftward from the widthwise center of the machine body 2 will be described as a machine-body outward direction. In other words, the machine-body outward direction extends away in the machine-body width direction from the widthwise center of the machine body 2. A direction opposite the machine-body outward direction will be described as a machine-body inward direction. In other words, the machine-body inward direction extends in the machine-body width direction toward the widthwise center of the machine body 2.

As illustrated in FIG. 14, the machine body 2 includes a bottom wall 6, left and right sidewalls 7, a front wall 8, and support frames 9 provided behind the sidewalls 7. An upper opening is provided between the left and right sidewalls 7. As illustrated in FIG. 13, the rear end of the machine body 2 is provided with an openable-closable cover member 10 that covers a rear-end opening between the left and right support frames 9.

As illustrated in FIG. 14, an intermediate portion, in the vertical direction, of the rear surface of the cabin 5 is pivotably supported by a support bracket 11, provided in the machine body 2, via a support shaft 12 having a rotation axis extending in the machine-body width direction, such that the cabin 5 is pivotable upward about the support shaft 12. When the cabin 5 is set in a lowered position, the lower end of the front portion of the cabin 5 is placed on the upper end of the front wall 8 of the machine body 2. The cabin 5 has an upper surface covered with a roof, left and right side surfaces covered with sidewalls having a large number of rectangular holes, a rear surface whose upper portion is covered with rear glass, and a bottom surface whose central portion in the front-rear direction K3 is covered with a bottom wall, so as to have a shape of a box with a front opening. The front of the cabin 5 defines and functions as an entrance/exit.

As illustrated in FIG. 14, a travel operation device 14 used to operate the traveling devices 4 is disposed at one side (e.g., left side), in the machine-body width direction, of the operator's seat 13 within the cabin 5. Moreover, a work operation device 15 used to operate the working device 3 is disposed at the other side (e.g., right side), in the machine-body width direction, of the operator's seat 13.

The traveling devices 4 are provided at the left and right sides of the machine body 2. The traveling devices 4 are speed-changeable between two high and low speed modes (i.e., a first speed mode and a second speed mode faster than the first speed mode). As illustrated in FIG. 13, each traveling device 4 is a crawler-type traveling device that includes front and rear driven wheels 16, a driving wheel 17 disposed above an area between the front driven wheel 16 and the rear driven wheel 16 and toward the rear, a plurality of track rollers 18 disposed between the front driven wheel 16 and the rear driven wheel 16, and an endless crawler belt 19 wrapped around the driven wheels 16, the driving wheel 17, and the track rollers 18. Alternatively, each traveling device 4 may be a wheel-type traveling device.

Each of the driven wheels 16 and the track rollers 18 is supported in a rotatable manner about a lateral axis (i.e., a rotation axis extending in the machine-body width direction) by a track frame 20 attached to the machine body 2. The driving wheel 17 is attached to a rotating drum of a corresponding hydraulically-driven travel motor 21L or 21R (i.e., a wheel motor) attached to the track frame 20. The driving wheel 17 is driven about a lateral axis by the travel motor 21L or 21R so as to cause the crawler belt 19 to circulate in the circumferential direction, whereby the working machine 1 moves forward and rearward.

As illustrated in FIG. 13, the working device 3 includes a pair of arms 22 and a bucket 23 (i.e., a working tool) attached to the distal ends of the pair of arms 22.

The arms 22 are respectively disposed at the left and right sides of the cabin 5, and the front portions of the left and right arms 22 are coupled to each other by a coupler. With regard to each arm 22, the base end (i.e., the rear end) thereof is supported in a vertically pivotable manner by a rear upper portion of the machine body 2 via a first lift link 24 and a second lift link 25, thereby raising and lowering the distal end (i.e., the front end) of the arm 22 in front of the machine body 2.

Furthermore, a lift cylinder 26 defined by a double-acting-type hydraulic cylinder is provided between the base end of each arm 22 and a rear lower portion of the machine body 2. By causing the lift cylinder 26 to extend and contract, the arm 22 pivots in the vertical direction. Attachment brackets 27 are coupled to the distal ends of the arms 22 in a rotatable manner about a lateral axis, and the rear surface of the bucket 23 is attached to the left and right attachment brackets 27.

Bucket cylinders 28 defined by double-acting-type hydraulic cylinders are provided between the attachment brackets 27 and the distal ends of the arms 22. By causing the bucket cylinders 28 to extend and contract, the bucket 23 pivots (i.e., performs a shoveling operation and a dumping operation).

The bucket 23 is attachable to and detachable from the attachment brackets 27. By removing the bucket 23 and attaching various types of hydraulic attachments (i.e., hydraulically-driven working tools) to the attachment brackets 27, various kinds of working operations other than an excavating operation (or other kinds of excavating operations) can be performed.

As illustrated in FIG. 14, an engine (i.e., a prime mover) 29 is provided at a rear portion on the bottom wall 6 of the machine body 2. Moreover, a fuel tank 30 and a hydraulic fluid tank 31 are provided at a front portion on the bottom wall 6.

A hydraulic driving device 32 that hydraulically drives the left and right travel motors 21L and 21R (i.e., the traveling devices 4) is provided in front of the engine 29. A first pump P1, a second pump P2, and a third pump P3 are provided in front of the hydraulic driving device 32. The first pump P1, the second pump P2, and the third pump P3 are hydraulic pumps that are driven by a driving force of the engine 29. Specifically, by being driven by the driving force of the engine 29, the first pump P1, the second pump P2, and the third pump P3 take in a hydraulic fluid retained in the hydraulic fluid tank 31 and output the hydraulic fluid. Furthermore, a control valve 33 (i.e., a hydraulic controller) for the working device 3 and a proportional valve unit PCU are provided at an intermediate portion, in the front-rear direction K3, of the right sidewall 7 of the machine body 2.

Moreover, an accelerator pedal 53 (i.e., an accelerator operation member) to be foot-operated to increase and decrease the engine speed of the engine 29 and an accelerator lever 54 (i.e., an accelerator operation member) to be hand-operated to increase and decrease the engine speed of the engine 29 are provided at the front of the machine body 2.

The accelerator lever 54 is interconnected with the accelerator pedal 53 via, for example, a cable such that when the accelerator lever 54 is operated, the accelerator pedal 53 pivots in conjunction with the operation. Furthermore, the accelerator lever 54 can be maintained at an operated position in accordance with a frictional force. Moreover, the accelerator pedal 53 is operable by being stepped on from a position to which the accelerator pedal 53 is operated by the accelerator lever 54, and when the stepping operation is released, a return spring returns the accelerator pedal 53 to the original position prior to the stepping operation.

An accelerator sensor AS that detects an amount by which the accelerator pedal 53 is stepped on (i.e., accelerator operation amount) is provided below the accelerator pedal 53.

FIG. 1 to FIG. 5 illustrate the hydraulic system according to this preferred embodiment.

As illustrated in FIG. 1, each of the first to third pumps P1, P2, and P3 includes a fixed-displacement gear pump driven by the driving force of the engine 29. The first to third pumps P1, P2, and P3 take in the hydraulic fluid retained in the hydraulic fluid tank 31 and output the hydraulic fluid as a pressure fluid.

The first pump P1 (i.e., a main pump) is used for driving the lift cylinders 26, the bucket cylinders 28, or a hydraulic actuator for the attachment attached to the distal ends of the arms 22.

The second pump P2 (i.e., a pilot pump or a charge pump) is mainly used for supplying control signal pressure (i.e., pilot pressure).

The third pump P3 (i.e., a sub pump) is used to increase the flow rate of the hydraulic fluid to be supplied to the hydraulic actuator for the attachment attached to the distal ends of the arms 22 if the hydraulic actuator requires a large capacity.

Figure 4:
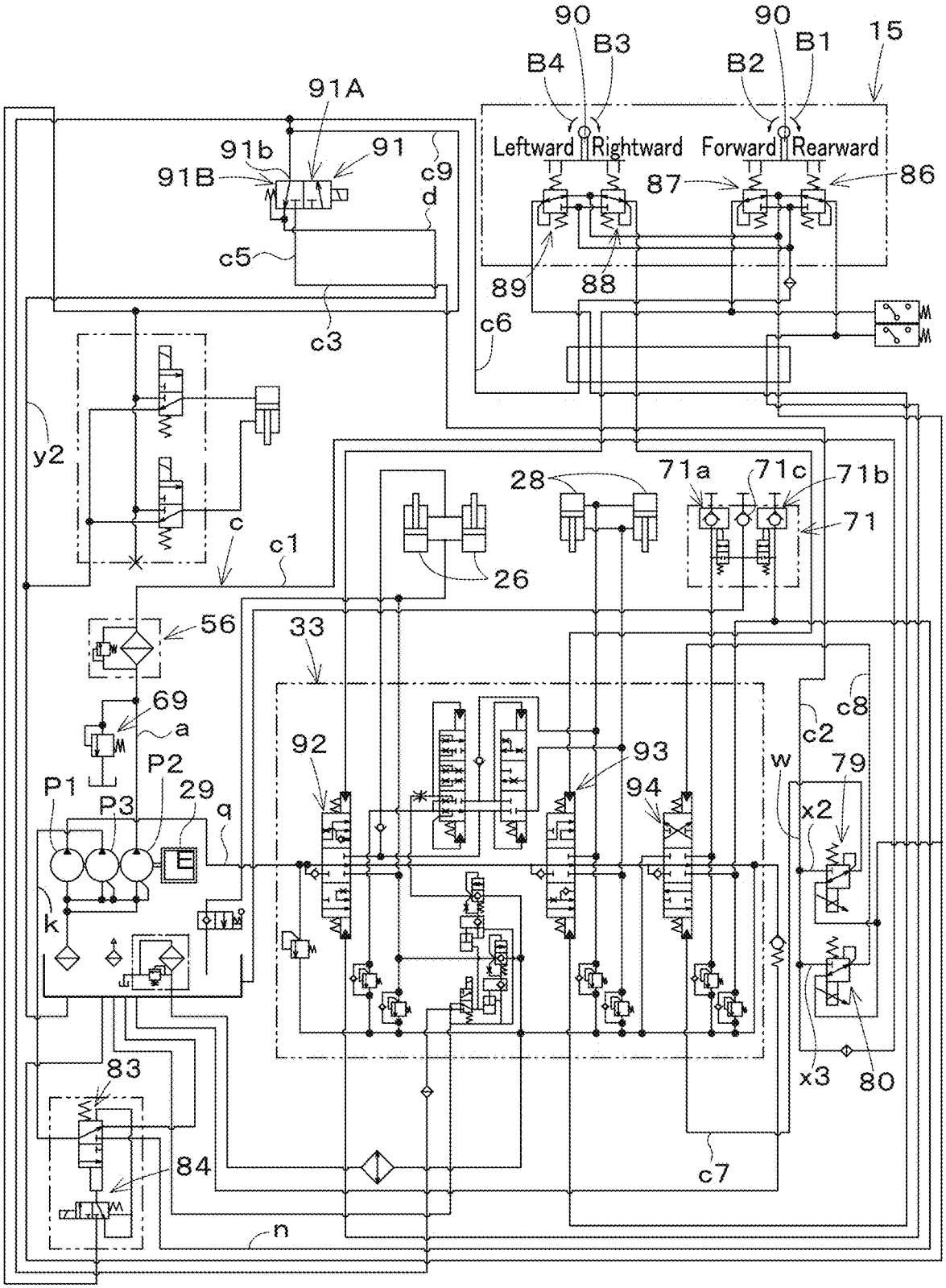
FIG. 4 illustrates a hydraulic circuit of for working.

As illustrated in FIG. 1 and FIG. 4, the control valve 33 for the working device 3 includes an arm control valve 92 to control the lift cylinders 26, a bucket control valve 93 to control the bucket cylinders 28, and an SP control valve 94 to control the hydraulic actuator for the attachment attached to, for example, the distal ends of the arms 22. Each of the arm control valve 92, the bucket control valve 93, and the SP control valve 94 includes, for example, a pilot-type linear spool three-position switching valve (i.e., a pilot-operated switching valve to be switched by pilot pressure).

Figure 3:
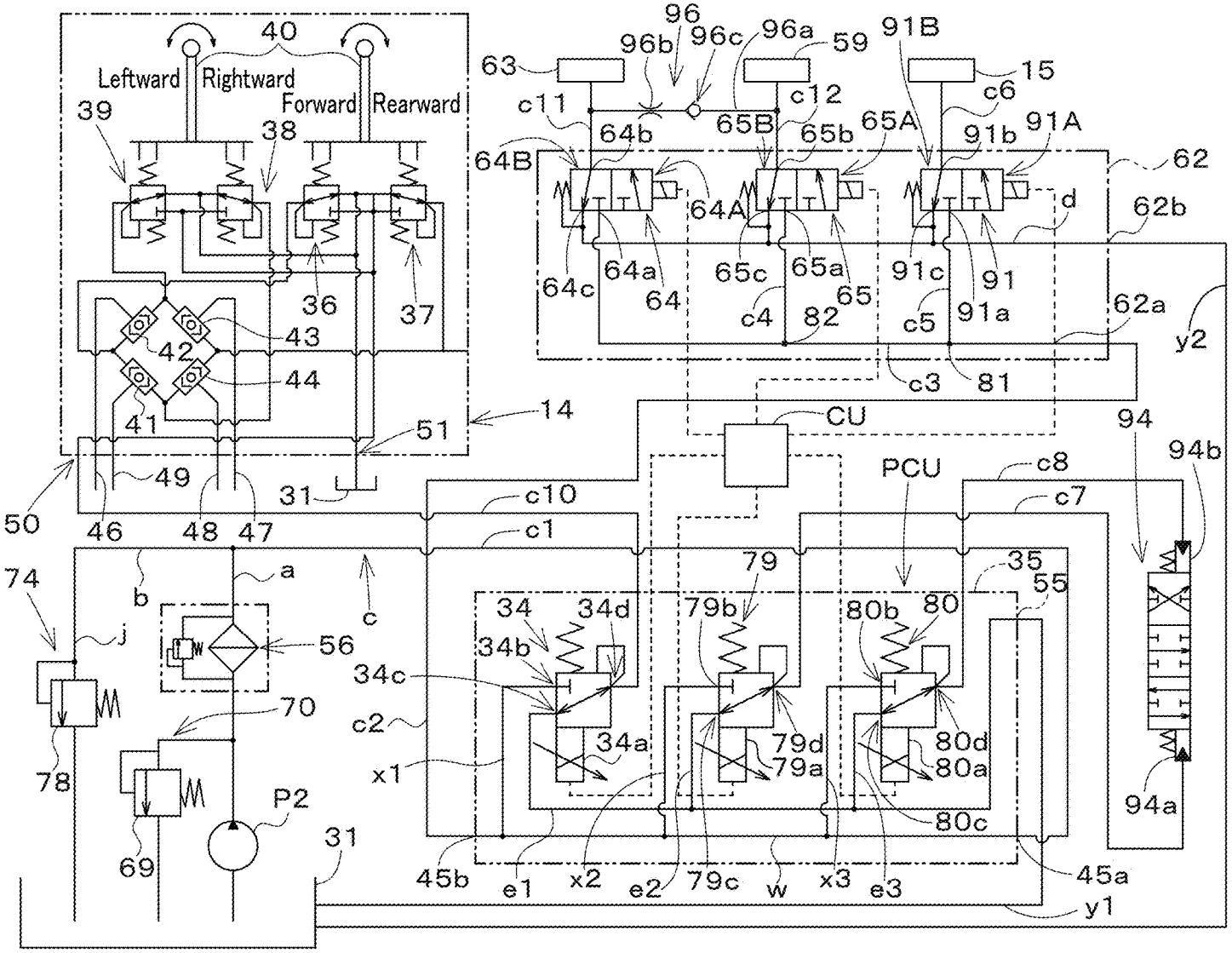
FIG. 3 illustrates a hydraulic circuit of a relevant portion.

As illustrated in FIG. 1 and FIG. 3, the proportional valve unit PCU has a valve body 35 and at least one proportional valve 34, 79, or 80 included in the valve body 35. In this preferred embodiment, the valve body 35 includes a plurality of proportional valves 34, 79, and 80. Specifically, three proportional valves 34, 79, and 80 are provided.

As illustrated in FIG. 3, each of the proportional valves 34, 79, and 80 includes an electromagnetic proportional valve. One of the three proportional valves is a traveling pressure control valve 34 to control the pressure (i.e., primary pressure of the travel operation device 14) of the hydraulic fluid (i.e., a pilot fluid) to be supplied to the travel operation device (i.e., a supply target) 14, and the remaining two proportional valves are SP operation valves 79 and 80 to control the pressure (i.e., pilot pressure) of the hydraulic fluid to be supplied to pressure receivers 94*a* and 94*b* of the SP control valve 94 (i.e., a supply target) (i.e., for pilot-operating the SP control valve 94).

The traveling pressure control valve 34, the SP operation valve 79, and the SP operation valve 80 have proportional solenoids 34*a*, 79*a*, and 80*a*, primary ports 34*b*, 79*b*, and 80*b*, secondary ports 34*d*, 79*d*, and 80*d*, and tank ports 34*c*, 79*c*, and 80*c*, respectively. Each of the proportional solenoids 34*a*, 79*a*, and 80*a* desirably controls the spool position in accordance with the magnitude of applied current to adjust the valve opening, thereby controlling the pressure of the hydraulic fluid to be output. Each of the primary ports 34*b*, 79*b*, and 80*b* receives the hydraulic fluid output from the second pump P2. Each of the secondary ports 34*d*, 79*d*, and 80*d* outputs the pressure-adjusted hydraulic fluid. Each of the tank ports 34*c*, 79*c*, and 80*c* communicates with the hydraulic fluid tank 31. In a closed state, the proportional valves 34, 79, and 80 block the communication between the primary ports 34*b*, 79*b*, and 80*b* and the secondary ports 34*d*, 79*d*, and 80*d* and allow the secondary ports 34*d*, 79*d*, and 80*d* to communicate with the tank ports 34*c*, 79*c*, and 80*c*, so as to return the hydraulic fluid from a tenth hydraulic fluid passage c10 (i.e., a supply target) to the hydraulic fluid tank 31. Furthermore, when opened, the proportional valves 34, 79, and 80 allow the primary ports 34*b*, 79*b*, and 80*b* to communicate with the secondary ports 34*d*, 79*d*, and 80*d* and block the communication between the secondary ports 34*d*, 79*d*, and 80*d* and the tank ports 34*c*, 79*c*, and 80*c*, and each has an opening adjusted to set a set pressure thereof to output the hydraulic fluid having the set pressure from the secondary ports 34*d*, 79*d*, and 80*d*.

As illustrated in FIG. 3, the hydraulic system includes a controller CU that controls the traveling pressure control valve 34 and the SP operation valves 79 and 80. The proportional solenoids 34*a*, 79*a*, and 80*a* of the traveling pressure control valve 34 and the SP operation valves 79 and 80 are connected to the controller CU via transmission lines. The secondary pressure of each of the traveling pressure control valve 34 and the SP operation valves 79 and 80 is controlled in accordance with an output current (i.e., a command signal) output from the controller CU to each of the proportional solenoids 34*a*, 79*a*, and 80*a*.

The valve body 35 has a shape of, for example, a rectangular block. The valve body 35 has a heat-up fluid passage w extending therethrough. For example, the heat-up fluid passage w extends linearly between opposing surfaces of the valve body 35.

The heat-up fluid passage w does not necessarily have to extend linearly through the valve body 35 and may have any shape, such as an L-shape, a U-shape, a cranked-shape, or a helical shape.

A first-end port 45*a* of the heat-up fluid passage w defines and functions as an inlet port (i.e., an initial end of the heat-up fluid passage w) from which the hydraulic fluid output from the second pump P2 flows in, whereas a second-end port 45*b* defines and functions as an outlet port (i.e., a terminal end of the heat-up fluid passage w) from which the hydraulic fluid flowing into the heat-up fluid passage w flows out. The proportional solenoids 34*a*, 79*a*, and 80*a* are arranged from upstream (i.e., the first-end port 45*a*) toward downstream (i.e., the second-end port 45*b*) of the heat-up fluid passage w. In this preferred embodiment, the SP operation valve 80, the SP operation valve 79, and the traveling pressure control valve 34 are arranged in this sequence.

The valve body 35 has three branch fluid passages x1, x2, and x3 branching off from the heat-up fluid passage w. The branch fluid passage x1 of the three branch fluid passages x1, x2, and x3 is connected to the primary port 34*b* of the traveling pressure control valve 34, the branch fluid passage x2 of the two remaining branch fluid passages x2 and x3 is connected to the primary port 79*b* of the SP operation valve 79, and the branch fluid passage x3 is connected to the primary port 80*b* of the SP operation valve 80.

Furthermore, the valve body 35 has a tank port 55 connected to the hydraulic fluid tank 31 via a drain fluid passage y1, a drain passage e1 that connects the tank port 55 and the tank port 34*c* of the traveling pressure control valve 34, a drain connection passage e2 that connects the drain passage e1 and the tank port 79*c* of the SP operation valve 79, and a drain connection passage e3 that connects the drain passage e1 and the tank port 80*c* of the SP operation valve 80.

As illustrated in FIG. 1, an output port of the first pump P1 is connected to an output fluid passage q through which the output fluid (i.e., the hydraulic fluid) output from the first pump P1 flows, an output port of the second pump P2 is connected to an output fluid passage a through which the output fluid (i.e., the hydraulic fluid) output from the second pump P2 flows, and an output port of the third pump P3 is connected to an output fluid passage k through which the output fluid (i.e., the hydraulic fluid) output from the third pump P3 flows.

Figure 2:
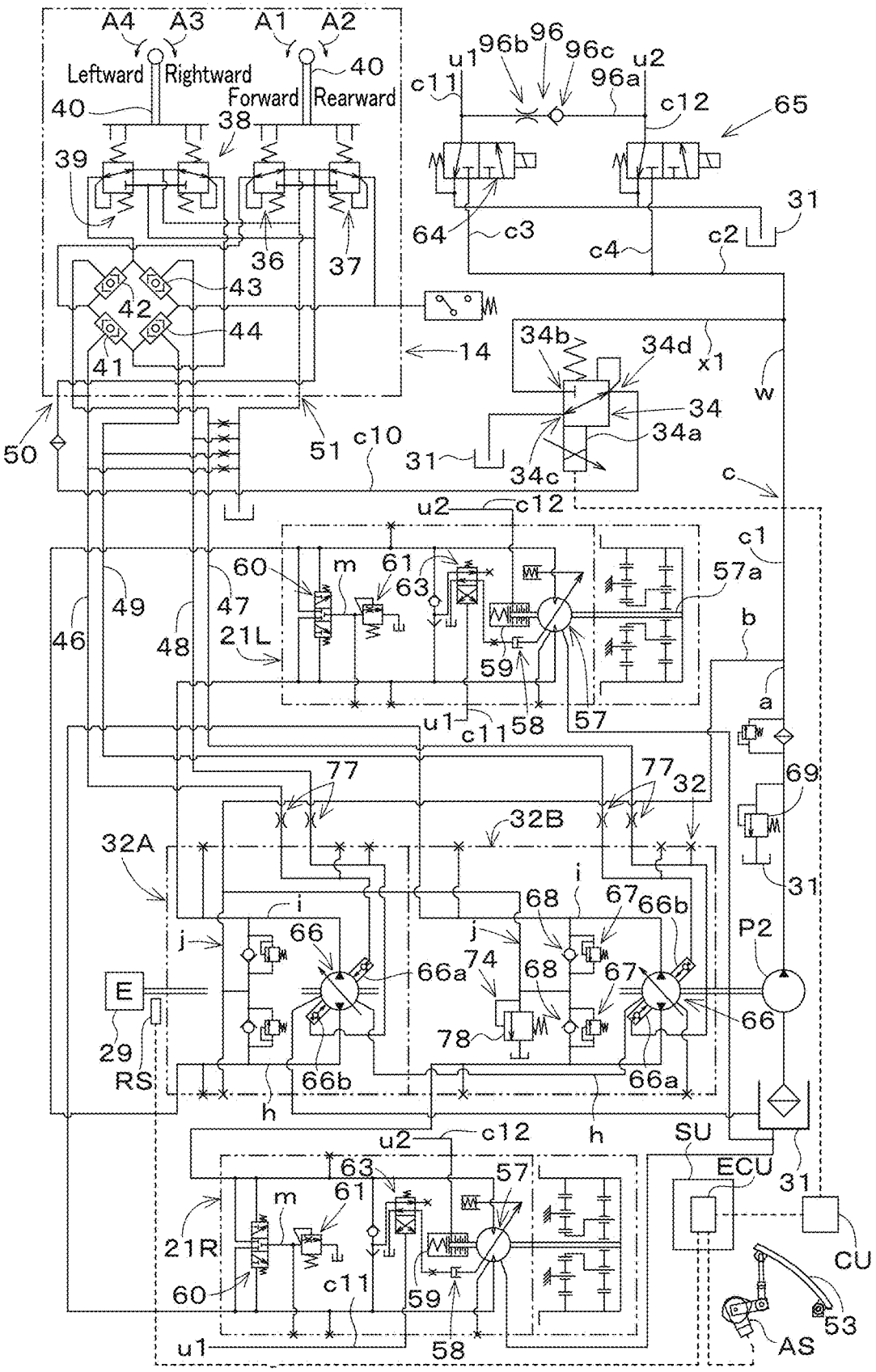
FIG. 2 illustrates a hydraulic circuit for traveling.

As illustrated in FIG. 1 and FIG. 2, the output fluid passage a connected to the second pump P2 branches off into a charge-pressure supply passage b and a pilot-pressure supply passage c. The output fluid passage a is provided with an oil filter 56 and is connected to a protection relief circuit 70 having a pump protection relief valve 69 upstream of the oil filter 56. In a case where the oil filter 56 is clogged or the fluid in the hydraulic fluid tank 31 is at a low temperature, if the output fluid passage a is in a high-pressure state when the engine 29 is started, the pump protection relief valve 69 relieves the pressure to protect the second pump P2 and the oil filter 56.

As illustrated in FIG. 3, the pilot-pressure supply passage c has a first hydraulic fluid passage c1 having an initial end connected to the output fluid passage a and a terminal end connected to the inlet port 45*a* of the heat-up fluid passage w, and also has a second hydraulic fluid passage c2 having an initial end connected to the outlet port 45*b* of the heat-up fluid passage w. The heat-up fluid passage w defines and functions as a portion of the pilot-pressure supply passage c. A terminal end of the second hydraulic fluid passage c2 is connected to an inlet port 62*a* of a valve block 62 including at least one of switching valves (i.e., a second-speed switching valve 64, a brake release valve 65, and a work lock valve 91 in this preferred embodiment) including electromagnetic two-position switching valves. The second-speed switching valve 64 is used to switch the traveling devices 4 to the second speed mode. The brake release valve 65 is used to release the braking force applied to the traveling devices 4. The work lock valve 91 is used to set the work operation device 15 used to operate the working device 3 in a non-operable mode.

Each of the second-speed switching valve 64, the brake release valve 65, and the work lock valve 91 includes an electromagnetic two-position switching valve. Solenoids of the second-speed switching valve 64, the brake release valve 65, and the work lock valve 91 are connected to the controller CU via transmission lines. In other words, the second-speed switching valve 64, the brake release valve 65, and the work lock valve 91 are operated by the controller CU. Specifically, the second-speed switching valve 64, the brake release valve 65, and the work lock valve 91 are switchable between open positions 64A, 65A, and 91A and closed positions 64B, 65B, and 91B in accordance with command signals from the controller CU. Furthermore, the second-speed switching valve 64, the brake release valve 65, and the work lock valve 91 have first ports 64*a*, 65*a*, and 91*a*, second ports 64*b*, 65*b*, and 91*b*, and drain ports 64*c*, 65*c*, and 91*c*, respectively. When the second-speed switching valve 64, the brake release valve 65, and the work lock valve 91 are switched to the open positions 64A, 65A, and 91A, the first ports 64*a*, 65*a*, and 91*a* and the second ports 64*b*, 65*b*, and 91*b* communicate with each other, and the communication between the second ports 64*b*, 65*b*, and 91*b* and the drain ports 64*c*, 65*c*, and 91*c* becomes blocked. When the second-speed switching valve 64, the brake release valve 65, and the work lock valve 91 are switched to the closed positions 64B, 65B, and 91B, the communication between the first ports 64*a*, 65*a*, and 91*a* and the second ports 64*b*, 65*b*, and 91*b* becomes blocked, and the second ports 64*b*, 65*b*, and 91*b* communicate with the drain ports 64*c*, 65*c*, and 91*c*. When in the open position 64A, the second-speed switching valve 64 supplies the hydraulic fluid passing through the heat-up fluid passage w to a cylinder switching valve (i.e., a hydraulic device) 63 to be described later. When in the closed position 64B, the second-speed switching valve 64 does not supply the hydraulic fluid to the cylinder switching valve 63 and returns the hydraulic fluid from the cylinder switching valve 63 to the hydraulic fluid tank 31. When in the open position 65A, the brake release valve 65 supplies the hydraulic fluid passing through the heat-up fluid passage w to a brake cylinder (i.e., a hydraulic device) 59 to be described later. When in the closed position 65B, the brake release valve 65 does not supply the hydraulic fluid to the brake cylinder 59 and returns the hydraulic fluid from the brake cylinder 59 to the hydraulic fluid tank 31. When in the open position 91A, the work lock valve 91 supplies the hydraulic fluid passing through the heat-up fluid passage w to the work operation device (i.e., a hydraulic device) 15. When in the closed position 91B, the work lock valve 91 does not supply the hydraulic fluid to the work operation device 15 and returns the hydraulic fluid from the work operation device 15 to the hydraulic fluid tank 31.

As illustrated in FIG. 3, the valve block 62 is provided with an inlet port 62*a* connected to the second hydraulic fluid passage c2 and an outlet port 62*b* communicating with the hydraulic fluid tank 31 via a drain fluid passage y2. Furthermore, the valve block 62 has a third hydraulic fluid passage c3, a fourth hydraulic fluid passage c4, a fifth hydraulic fluid passage c5, and a drain passage d. The third hydraulic fluid passage c3 has an initial end connected to the inlet port 62*a* (i.e., the second hydraulic fluid passage c2) and a terminal end connected to the first port 64*a* of the second-speed switching valve 64. The fourth hydraulic fluid passage c4 branches off from the third hydraulic fluid passage c3 and is connected to the first port 65*a* of the brake release valve 65. The fifth hydraulic fluid passage c5 branches off from the third hydraulic fluid passage c3 and is connected to the first port 91*a* of the work lock valve 91. The drain passage d is connected to the outlet port 62*b* and communicates with the hydraulic fluid tank 31 via the drain fluid passage y2. Furthermore, the drain passage d is connected to the drain ports 64*c*, 65*c*, and 91*c* of the second-speed switching valve 64, the brake release valve 65, and the work lock valve 91. A branch point 81 of the fifth hydraulic fluid passage c5 is located upstream of a branch point 82 of the fourth hydraulic fluid passage c4.

A working hydraulic system will now be described with reference to FIG. 1 and FIG. 4.

The work operation device 15 includes a remote control valve used to pilot-operate the arm control valve 92 and the bucket control valve 93, and has an arm-raising pilot valve 86, an arm-lowering pilot valve 87, a bucket-dumping pilot valve 88, a bucket-shoveling pilot valve 89, and a (single) common operation lever 90 for these pilot valves 86, 87, 88, and 89.

A primary port of the work operation device 15 is connected to the second port 91*b* of the work lock valve 91 via a sixth hydraulic fluid passage c6. When the work lock valve 91 is energized, the work lock valve 91 is switched to the open position 91A, so that the output fluid from the second pump P2 can be supplied to primary ports of the pilot valves 86, 87, 88, and 89 via the sixth hydraulic fluid passage c6. When the work lock valve 91 is deenergized, the work lock valve 91 is switched to the closed position 91B, so that the pressure fluid from the second pump P2 cannot be supplied to the pilot valves 86, 87, 88, and 89, whereby the work operation device 15 is set in a non-operable mode.

The arm control valve 92, the bucket control valve 93, and the SP control valve 94 are connected to the output fluid passage q of the first pump P1 to define a series circuit, and the output fluid from the first pump P1 can be supplied to the lift cylinders 26, the bucket cylinders 28, or the hydraulic actuator for the attachment.

The operation lever 90 of the work operation device 15 is swingable forward, rearward, leftward, rightward, and in a diagonal direction between the forward, rearward, leftward, and rightward directions from a neutral position. When the operation lever 90 is operated in a swinging fashion, the pilot valves 86, 87, 88, and 89 of the work operation device 15 are operated, and pilot pressure proportional to the amount by which the operation lever 90 is operated from the neutral position is output from secondary ports of the operated pilot valves 86, 87, 88, and 89.

In this preferred embodiment, when the operation lever 90 is swung rearward (i.e., in a direction indicated by an arrow B1 in FIG. 4), the arm-raising pilot valve 86 is operated so that the arm control valve 92 is operated in a direction to extend the lift cylinders 26, whereby the arms 22 are raised at a rate proportional to the amount by which the operation lever 90 is swung.

When the operation lever 90 is swung forward (i.e., in a direction indicated by an arrow B2 in FIG. 4), the arm-lowering pilot valve 87 is operated so that the arm control valve 92 is operated in a direction to contract the lift cylinders 26, whereby the arms 22 are lowered at a rate proportional to the amount by which the operation lever 90 is swung.

When the operation lever 90 is swung rightward (i.e., in a direction indicated by an arrow B3 in FIG. 4), the bucket-dumping pilot valve 88 is operated so that the bucket control valve 93 is operated in a direction for extending the bucket cylinders 28, whereby the bucket 23 moves in a dumping motion at a rate proportional to the amount by which the operation lever 90 is swung.

When the operation lever 90 is swung leftward (i.e., in a direction indicated by an arrow B4 in FIG. 4), the bucket-shoveling pilot valve 89 is operated so that the bucket control valve 93 is operated in a direction for contracting the bucket cylinders 28, whereby the bucket 23 moves in a shoveling motion at a rate proportional to the amount by which the operation lever 90 is swung.

Furthermore, when the operation lever 90 is swung in a diagonal direction, a combination of the raising or lowering operation of the arms 22 and the shoveling or dumping operation of the bucket 23 can be performed.

The SP control valve 94 is connected to a pair of pressure-fluid supply-and-drain joints 71*a* and 71*b* of a hydraulic-hose-connection joint unit 71 via a hydraulic pipe. By connecting the hydraulic actuator for the attachment to the joints 71*a* and 71*b* via, for example, a hydraulic hose, the attachment becomes operable by using the SP control valve 94.

The joint unit 71 includes a drain joint 71*c*.

The SP control valve 94 is operable by the aforementioned pair of SP operation valves 79 and 80. The SP operation valves 79 and 80 are operable by using, for example, a slide button provided at the top of the operation lever 90 of the work operation device 15.

As illustrated in FIG. 3, the secondary port 79*d* of the SP operation valve 79 is connected to the pressure receiver 94*a* of the SP control valve 94 via a seventh hydraulic fluid passage c7, and the secondary port 80*d* of the SP operation valve 80 is connected to the pressure receiver 94*b* of the SP control valve 94 via an eighth hydraulic fluid passage c8.

When the slide button provided on the operation lever 90 is slid in one direction, an operation signal is input to the controller CU, and a command signal is output from the controller CU to the SP operation valve 79. Accordingly, pilot pressure proportional to the operation amount is output from the SP operation valve 79 to the pressure receiver 94*a* of the SP control valve 94.

When the slide button is slid in the other direction, a command signal is output from the controller CU to the SP operation valve 80. Accordingly, pilot pressure proportional to the operation amount is output from the SP operation valve 80 to the pressure receiver 94*b* of the SP control valve 94.

As illustrated in FIG. 4, the output fluid passage k of the third pump P3 is connected to a high flow valve 83. The high flow valve 83 includes a pilot-type two-position switching valve. Furthermore, the high flow valve 83 is switchable between a non-increase position to return the output fluid from the third pump P3 to the hydraulic fluid tank 31 and an increase position to cause the output fluid from the third pump P3 to flow toward the joint 71*b* via an increase fluid passage n. The high flow valve 83 is biased by a spring in a direction to switch the high flow valve 83 to the non-increase position, and is switched to the increase position in accordance with pilot pressure applied to a pressure receiver.

Whether or not pilot pressure is to be applied to the pressure receiver of the high flow valve 83 is dependent on a switching valve 84 formed of an electromagnetic two-position switching valve. When the switching valve 84 is energized, pilot pressure in a ninth hydraulic fluid passage c9 branching off from the sixth hydraulic fluid passage c6 is applied to the pressure receiver of the high flow valve 83. When the switching valve 84 is deenergized, the pilot pressure is not applied to the pressure receiver of the high flow valve 83.

A traveling hydraulic system will now be described with reference to FIG. 1, FIG. 2, and FIG. 3.

The travel operation device 14 includes a remote control valve used to pilot-operate a hydraulic static transmission (HST) pump 66 of an HST (i.e., a continuously variable transmission) that drives the traveling devices 4, and has a forward-travel pilot valve 36, a rearward-travel pilot valve 37, a right-turn pilot valve 38, a left-turn pilot valve 39, a (single) common traveling lever 40 for these pilot valves 36, 37, 38, and 39, first to fourth shuttle valves 41, 42, 43, and 44, a pump port 50 that receives the pressure fluid from the second pump P2, and a tank port 51 that communicates with the hydraulic fluid tank 31.

The pump port 50 of the travel operation device 14 is connected to the secondary port 34*d* of the traveling pressure control valve 34 via a tenth hydraulic fluid passage c10.

Thus, the output fluid from the second pump P2 is supplied as a hydraulic fluid (i.e., a pilot fluid) to the travel operation device 14. The hydraulic fluid supplied to the travel operation device 14 can be supplied to the primary ports of the pilot valves 36, 37, 38, and 39 of the travel operation device 14, and the hydraulic fluid that is not to be used is drained from the tank port 51.

The left and right travel motors 21L and 21R each have an HST motor 57 (i.e., a traveling hydraulic motor), which includes a swash-plate variable displacement axial motor that is speed-changeable between two high and low speed modes, a swash-plate switching cylinder 58 that speed-changes the HST motor 57 between the two high and low speed modes by switching the angle of the swash plate of the HST motor 57, the brake cylinder 59 that applies a braking force to an output shaft 57*a* of the HST motor 57 (i.e., an output shaft 57*a* of the travel motor 21L or 21R), a flushing valve 60, and a flushing relief valve 61.

The swash-plate switching cylinder 58 is to be switched by the cylinder switching valve 63 including a pilot-type two-position switching valve between a state where the pressure fluid is applied and a state where the pressure fluid is not applied. The HST motor 57 is set in the first speed mode when the pressure fluid is not applied to the swash-plate switching cylinder 58, and the HST motor 57 is switched to the second speed mode when the pressure fluid is applied to the swash-plate switching cylinder 58.

The cylinder switching valve 63 is connected to the second-speed switching valve 64 via an eleventh hydraulic fluid passage c11, such that the cylinder switching valve 63 is switched by the second-speed switching valve 64.

The brake cylinder 59 contains a spring that applies a braking force to the output shaft 57*a* of the HST motor 57, and the brake cylinder 59 is connected to the brake release valve 65 via a twelfth hydraulic fluid passage c12. When the brake release valve 65 is energized, the hydraulic fluid in the twelfth hydraulic fluid passage c12 is applied to the brake cylinder 59, so that the braking force applied to the output shaft 57*a* of the HST motor 57 is released.

The hydraulic driving device 32 includes a drive circuit 32A (i.e., a left drive circuit) for the left travel motor 21L and a drive circuit 32B (i.e., a right drive circuit) for the right travel motor 21R.

Each of the drive circuits 32A and 32B includes the HST pump (i.e., a travel hydraulic pump) 66 that is closed-circuit-connected to the HST motor 57 of the corresponding travel motor 21L or 21R by a pair of speed-changing fluid passages h and i, a high-pressure relief valve 67 that relieves the pressure from the higher-pressure speed-changing fluid passage h or i to the lower-pressure speed-changing fluid passage h or i when the pressure in the higher-pressure speed-changing fluid passage h or i reaches a set value or higher, and a charge circuit j for replenishing the lower-pressure speed-changing fluid passage h or i with the pressure fluid from the second pump P2 via a check valve 68.

The HST pump 66 in each of the drive circuits 32A and 32B is a swash-plate variable displacement axial pump driven by the driving force of the engine 29 and is also a pilot-type hydraulic pump (i.e., a swash-plate variable displacement hydraulic pump) in which the angle of the swash plate is changed in accordance with the pilot pressure.

Specifically, the HST pump 66 includes a forward-travel pressure receiver 66*a* and a rearward-travel pressure receiver 66*b* that receive the pilot pressure. The pilot pressure applied to these pressure receivers 66*a* and 66*b* causes the angle of the swash plate to change, thereby changing the output direction and the output amount of the hydraulic fluid. Consequently, the rotational output from each of the travel motors 21L and 21R can be changed in a stepless fashion to a direction (i.e., the forward direction) for moving the working machine 1 forward or a direction (i.e., the reverse direction) for moving the working machine 1 rearward.

Each charge circuit j is connected to the charge-pressure supply passage b, and the output fluid from the second pump P2 can be supplied to the charge circuit j. Furthermore, the charge circuit j in the right drive circuit 32B is connected to a main relief circuit 74 having a main relief valve 78.

The flushing valve 60 in each of the travel motors 21L and 21R is switched by the pressure in the higher-pressure speed-changing fluid passage h or i to connect the lower-pressure speed-changing fluid passage h or i to a flushing relief fluid passage m, and relieves a portion of the hydraulic fluid in the lower-pressure speed-changing fluid passage h or i to a fluid pool within a housing of the travel motor 21L or 21R via the flushing relief fluid passage m so as to replenish the lower-pressure speed-changing fluid passage h or i with the hydraulic fluid. The flushing relief valve 61 is provided in the flushing relief fluid passage m.

The HST motors 57, the flushing valves 60 and the like in the travel motors 21L and 21R, the drive circuits 32A and 32B, and the pairs of speed-changing fluid passages h and i constitute a discrete-type HST (hydraulic static transmission).

The traveling lever 40 of the travel operation device 14 is swingable forward, rearward, leftward, rightward, and in a diagonal direction between the forward, rearward, leftward, and rightward directions from a neutral position. When the traveling lever 40 is operated in a swinging fashion, the pilot valves 36, 37, 38, and 39 of the travel operation device 14 are operated, and pilot pressure proportional to the amount by which the traveling lever 40 is operated from the neutral position is output from secondary ports of the operated pilot valves 36, 37, 38, and 39.

When the traveling lever 40 is swung forward (i.e., in a direction indicated by an arrow A1 in FIG. 2), the forward-travel pilot valve 36 is operated so that pilot pressure is output from the forward-travel pilot valve 36. The pilot pressure is applied from the first shuttle valve 41 to the forward-travel pressure receiver 66*a* of the HST pump 66 in the left drive circuit 32A via a first flow passage 46 and is also applied from the second shuttle valve 42 to the forward-travel pressure receiver 66*a* of the right drive circuit 32B via a second flow passage 47. Consequently, the output shafts 57*a* of the left and right travel motors 21L and 21R rotate in the forward direction (i.e., forward) at a rate proportional to the amount by which the traveling lever 40 is swung, thereby causing the working machine 1 to move forward.

When the traveling lever 40 is swung rearward (i.e., in a direction indicated by an arrow A2 in FIG. 2), the rearward-travel pilot valve 37 is operated so that pilot pressure is output from the rearward-travel pilot valve 37. The pilot pressure is applied from the third shuttle valve 43 to the rearward-travel pressure receiver 66*b* of the HST pump 66 in the left drive circuit 32A via a third flow passage 48 and is also applied from the fourth shuttle valve 44 to the rearward-travel pressure receiver 66*b* of the HST pump 66 in the right drive circuit 32B via a fourth flow passage 49. Consequently, the output shafts 57*a* of the left and right travel motors 21L and 21R rotate in the reverse direction (i.e., rearward) at a rate proportional to the amount by which the traveling lever 40 is swung, thereby causing the working machine 1 to move rearward.

When the traveling lever 40 is swung rightward (i.e., in a direction indicated by an arrow A3 in FIG. 2), the right-turn pilot valve 38 is operated so that pilot pressure is output from the right-turn pilot valve 38. The pilot pressure is applied from the first shuttle valve 41 to the forward-travel pressure receiver 66*a* of the HST pump 66 in the left drive circuit 32A via the first flow passage 46 and is also applied from the fourth shuttle valve 44 to the rearward-travel pressure receiver 66*b* of the HST pump 66 in the right drive circuit 32B via the fourth flow passage 49. Consequently, the output shaft 57*a* of the left travel motor 21L rotates in the forward direction and the output shaft 57*a* of the right travel motor 21R rotates in the reverse direction, thereby causing the working machine 1 to turn rightward.

When the traveling lever 40 is swung leftward (i.e., in a direction indicated by an arrow A4 in FIG. 2), the left-turn pilot valve 39 is operated so that pilot pressure is output from the left-turn pilot valve 39. The pilot pressure is applied from the second shuttle valve 42 to the forward-travel pressure receiver 66*a* of the HST pump 66 in the right drive circuit 32B via the second flow passage 47 and is also applied from the third shuttle valve 43 to the rearward-travel pressure receiver 66*b* of the HST pump 66 in the left drive circuit 32A via the third flow passage 48. Consequently, the output shaft 57*a* of the right travel motor 21R rotates in the forward direction and the output shaft 57*a* of the left travel motor 21L rotates in the reverse direction, thereby causing the working machine 1 to turn leftward.

When the traveling lever 40 is swung diagonally, the rotational direction and the rotational speed of the output shafts 57*a* of the travel motors 21L and 21R are determined in accordance with a difference between the pilot pressure applied to the forward-travel pressure receiver 66*a* and the pilot pressure applied to the rearward-travel pressure receiver 66*b* of each of the drive circuits 32A and 32B, thereby causing the working machine 1 to turn rightward or leftward while moving forward or rearward.

Specifically, when the traveling lever 40 is swung diagonally leftward and forward, the working machine 1 turns leftward while moving forward at a rate corresponding to the swing angle of the traveling lever 40. When the traveling lever 40 is swung diagonally rightward and forward, the working machine 1 turns rightward while moving forward at a rate corresponding to the swing angle of the traveling lever 40. When the traveling lever 40 is swung diagonally leftward and rearward, the working machine 1 turns leftward while moving rearward at a rate corresponding to the swing angle of the traveling lever 40. When the traveling lever 40 is swung diagonally rightward and rearward, the working machine 1 turns rightward while moving rearward at a rate corresponding to the swing angle of the traveling lever 40.

Each of the first to fourth flow passages 46 to 49 is provided with a shock attenuation throttle 77. Since the supplying of the hydraulic fluid from the travel operation device 14 to the forward-travel pressure receivers 66*a* and the rearward-travel pressure receivers 66*b* of the HST pumps 66 and the returning of the hydraulic fluid from the forward-travel pressure receivers 66*a* and the rearward-travel pressure receivers 66*b* are performed via the shock attenuation throttles 77, a rapid change in the vehicle speed is prevented.

By using the accelerator pedal 53 or the accelerator lever 54, the engine speed of the engine 29 can be increased from idling rotation (1150 rpm) in which the operation amount of the accelerator operation member 53 or 54 is 0 to maximum rotation (2480 rpm) in which the accelerator operation member 53 or 54 is operated to a maximum. An increase in the engine speed of the engine 29 causes the rotation speed of the HST pumps 66 to increase so that the output amount from the HST pumps 66 increases, whereby the travel speed increases.

In this preferred embodiment, a common-rail-type electronically-controlled fuel supply unit SU is provided, and the engine 29 is supplied with fuel by the electronically-controlled fuel supply unit SU. The electronically-controlled fuel supply unit SU includes a common rail including a tubular pipe that stores fuel, a supply pump that sets the fuel in the fuel tank 30 in a high-pressure state and delivers the fuel to the common rail, an injector that injects the high-pressure fuel stored in the common rail into the cylinders of the engine 29, and a controller ECU that controls the amount of fuel injected from the injector.

In the controller ECU, the accelerator sensor AS that detects the amount by which the accelerator pedal 53 is operated and a rotation sensor RS that detects the actual engine speed (i.e., real engine speed) of the engine 29 are connected to each other via a transmission line. The controller ECU receives detection signals from the accelerator sensor AS and the rotation sensor RS.

Based on the detection signals from the accelerator sensor AS and the rotation sensor RS, the controller ECU controls the amount of fuel injected from the injector such that the engine 29 operates at an engine speed (i.e., a target engine speed) according to the operation amount of the accelerator pedal 53 or the accelerator lever 54 (i.e., determined in accordance with the accelerator operation member 53 or 54).

The controller CU is connected to the controller ECU of the electronically-controlled fuel supply unit SU via a transmission line. The information about the target engine speed and the real engine speed is input to the controller CU from the electronically-controlled fuel supply unit SU.

In the working machine 1 according to this preferred embodiment, the controller CU and the traveling pressure control valve 34 perform control to change the primary pressure of the pilot valves 36, 37, 38, and 39 of the travel operation device 14 in accordance with the real engine speed, thereby preventing an engine stall while improving the travel speed in work that involves a large load applied to the engine 29.

The hydraulic system according to this preferred embodiment includes a return circuit 97 through which the hydraulic fluid flowing into the heat-up fluid passage w is returned as a result of at least one of the switching valves (e.g., the second-speed switching valve 64, the brake release valve 65, and the work lock valve 91) and the proportional valves (e.g., the traveling pressure control valve 34) being operated by the controller CU during a heat-up operation.

As an alternative to the hydraulic system according to this preferred embodiment in which the return circuit 97 returns the hydraulic fluid to the hydraulic fluid tank 31, for example, the return circuit 97 may return the hydraulic fluid to an inlet of a hydraulic pump (i.e., the second pump P2). Specifically, there is a hydraulic system that does not have a hydraulic fluid tank installed therein and that is configured to cause the hydraulic fluid returning from each hydraulic device to return directly to the inlet of the hydraulic pump. In such a hydraulic system, the hydraulic fluid returning via the return circuit 97 is returned to the inlet of the hydraulic pump. Such a hydraulic system not having a hydraulic fluid tank installed therein is provided with a buffer tank connected to a fluid passage through which the hydraulic fluid is returned from each hydraulic device to the hydraulic pump.

Figure 5:
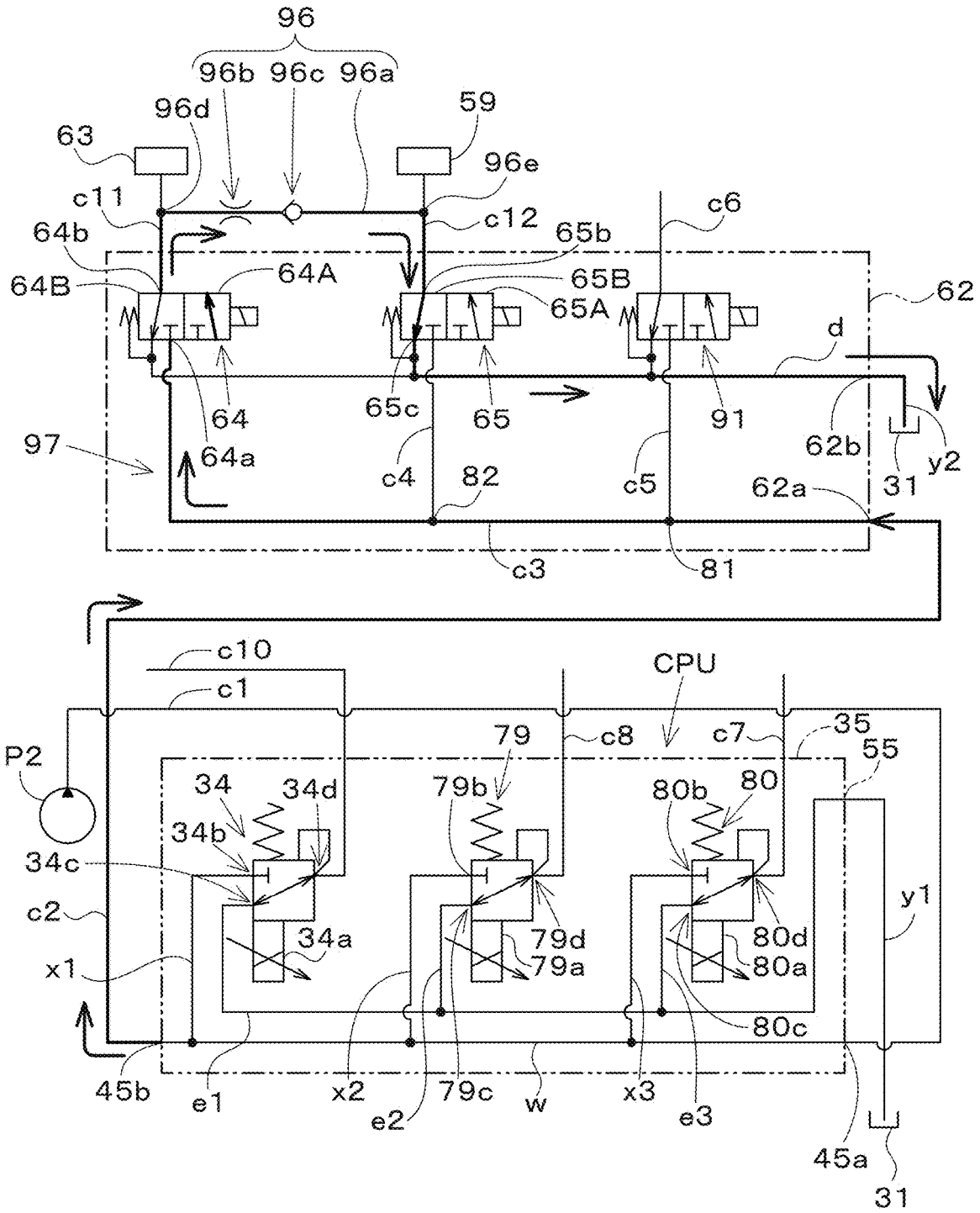
FIG. 5 illustrates a simplified hydraulic circuit according to a first preferred embodiment of the present invention.

FIG. 5 illustrates a hydraulic circuit according to a first preferred embodiment.

As illustrated in FIG. 5, the return circuit 97 according to the first preferred embodiment has a connection circuit 96 that connects the eleventh hydraulic fluid passage (i.e., a first fluid passage) c11 between the second-speed switching valve (i.e., a first switching valve) 64 and the cylinder switching valve (i.e., a first hydraulic device) 63 to the twelfth hydraulic fluid passage (i.e., a second fluid passage) c12 between the brake release valve (i.e., a second switching valve) 65 and the brake cylinder (i.e., a second hydraulic device) 59.

The connection circuit 96 has a connection fluid passage 96*a*, as well as a throttle 96*b* and a check valve 96*c* that are provided in the connection fluid passage 96*a*. The connection fluid passage 96*a* has one end connected to the eleventh hydraulic fluid passage c11 at a connection point 96*d* and the other end connected to the twelfth hydraulic fluid passage c12 at a connection point 96*e*. The throttle 96*b* is provided between the connection point 96*d* and the check valve 96*c* (i.e., upstream of the check valve 96*c*). The check valve 96*c* prevents the hydraulic fluid from flowing from the twelfth hydraulic fluid passage c12 toward the eleventh hydraulic fluid passage c11.

In the return circuit 97 according to the first preferred embodiment, the controller CU operates the second-speed switching valve (i.e., the first switching valve) 64 to the open position 64A in a state where the brake release valve (i.e., the second switching valve) 65 is in the closed position 65B, so that the hydraulic fluid from the heat-up fluid passage w is returned to the hydraulic fluid tank 31 via the eleventh hydraulic fluid passage (i.e., the first fluid passage) c11, the connection circuit 96, the twelfth hydraulic fluid passage (i.e., the second fluid passage) c12, and the brake release valve (i.e., the second switching valve) 65.

Specifically, when the engine 29 is started to activate the second pump P2 and the controller CU operates the second-speed switching valve 64 to the open position 64A in a state where the brake release valve 65 is in the closed position 65B during a heat-up operation, the hydraulic fluid output from the second pump P2 and flowing into the heat-up fluid passage w flows through the heat-up fluid passage w, flows out from the heat-up fluid passage w, flows through the second hydraulic fluid passage c2 and the third hydraulic fluid passage c3 to reach the first port 64*a* of the second-speed switching valve 64, and flows into the second-speed switching valve 64 from the first port 64*a*. The hydraulic fluid flowing in from the first port 64*a* of the second-speed switching valve 64 flows out from the second port 64*b*, flows to the twelfth hydraulic fluid passage c12 from the eleventh hydraulic fluid passage c11 via the connection circuit 96, reaches the second port 65*b* of the brake release valve 65, and flows into the brake release valve 65 from the second port 65*b*. The hydraulic fluid flowing in from the second port 65*b* of the brake release valve 65 flows into the hydraulic fluid tank 31 from the drain port 65*c* of the brake release valve 65 via the drain passage d and the drain fluid passage y2.

Thus, the return circuit 97 according to the first preferred embodiment illustrated in FIG. 5 includes the second hydraulic fluid passage c2, the third hydraulic fluid passage c3, the fluid passage of the second-speed switching valve 64, a portion of the eleventh hydraulic fluid passage c11, the connection circuit 96, a portion of the twelfth hydraulic fluid passage c12, the fluid passage of the brake release valve 65, the drain passage d, and the drain fluid passage y2.

When the air temperature is low, the hydraulic fluid retained in the hydraulic fluid tank 31 is circulated from the second pump P2 via the first hydraulic fluid passage c1, the heat-up fluid passage w, and the return circuit 97, so that the hydraulic fluid is heated up. This heated fluid flows through the heat-up fluid passage w, so that the valve body 35 (i.e., the proportional valves 34, 79, and 80) of the proportional valve unit PCU can be heated up. Accordingly, when the air temperature is low, a delayed response of the traveling pressure control valve 34 and the SP operation valves 79 and 80 can be prevented (i.e., favorable responsiveness can be achieved). In other words, with the hydraulic fluid being supplied to the proportional valves 34, 79, and 80 of the proportional valve unit PCU from the heat-up fluid passage w via the branch fluid passages x1, x2, and x3 within the valve body 35, the responsiveness can be favorably improved during a low-temperature state.

Furthermore, the hydraulic fluid flowing into the heat-up fluid passage w for a heat-up operation is returned to the hydraulic fluid tank 31 at a timing at which the controller CU operates a switching valve instead of being based on the settings of a relief valve as in the related art, so that the discharge of the hydraulic fluid from within the heat-up fluid passage w can be reliably controlled.

When a heat-up operation is to be performed, the controller CU operates a switching valve (i.e., the second-speed switching valve 64 in the first preferred embodiment) at a timing at which a temperature detector detects the temperature of the hydraulic fluid. In other words, the controller CU operates the switching valve based on detection information obtained by the temperature detector. In detail, if the temperature of the hydraulic fluid is lower than or equal to a predetermined temperature, the controller CU operates the switching valve such that the hydraulic fluid returns to the hydraulic fluid tank 31 via the return circuit 97. When the temperature of the hydraulic fluid becomes higher than or equal to the predetermined temperature, the controller CU operates the switching valve to regulate the returning of the hydraulic fluid via the return circuit 97.

The temperature detector is connected to the controller CU. The controller CU is capable of acquiring the detection information of the temperature detector. The temperature detector is provided somewhere in the circulation path of the hydraulic fluid returning to the hydraulic fluid tank 31 from the first hydraulic fluid passage c1 via the heat-up fluid passage w and the return circuit 97. Conceivable examples of the location where the temperature detector is provided include the hydraulic fluid tank 31, the inlet port 45*a* or the outlet port 45*b* of the heat-up fluid passage w, the tank port 55 of the valve body 35, the inlet port 62*a* or the outlet port 62*b* of the valve block 62, an oil filter provided upstream of the pump port 50, the first flow passage 46, and the second flow passage 47.

As an alternative to the first preferred embodiment in which the second-speed switching valve 64 is used as the first switching valve and the brake release valve 65 is used as the second switching valve, the first switching valve and the second switching valve may each be any switching valve switchable between an open position in which the hydraulic fluid passing through the heat-up fluid passage w is supplied to a hydraulic device and a closed position in which the hydraulic fluid is not supplied to the hydraulic device and the hydraulic fluid from the hydraulic device is returned to the hydraulic fluid tank 31. For example, the first switching valve may be the brake release valve 65 or the work lock valve 91. In other words, the first switching valve may be any one of the second-speed switching valve 64, the brake release valve 65, and the work lock valve 91. In that case, the second switching valve is any remaining one of the second-speed switching valve 64, the brake release valve 65, and the work lock valve 91 other than the first switching valve. In other words, the first switching valve and the second switching valve are a combination of one of the second-speed switching valve 64, the brake release valve 65, and the work lock valve 91 and one of the two remaining valves.

Figure 6:
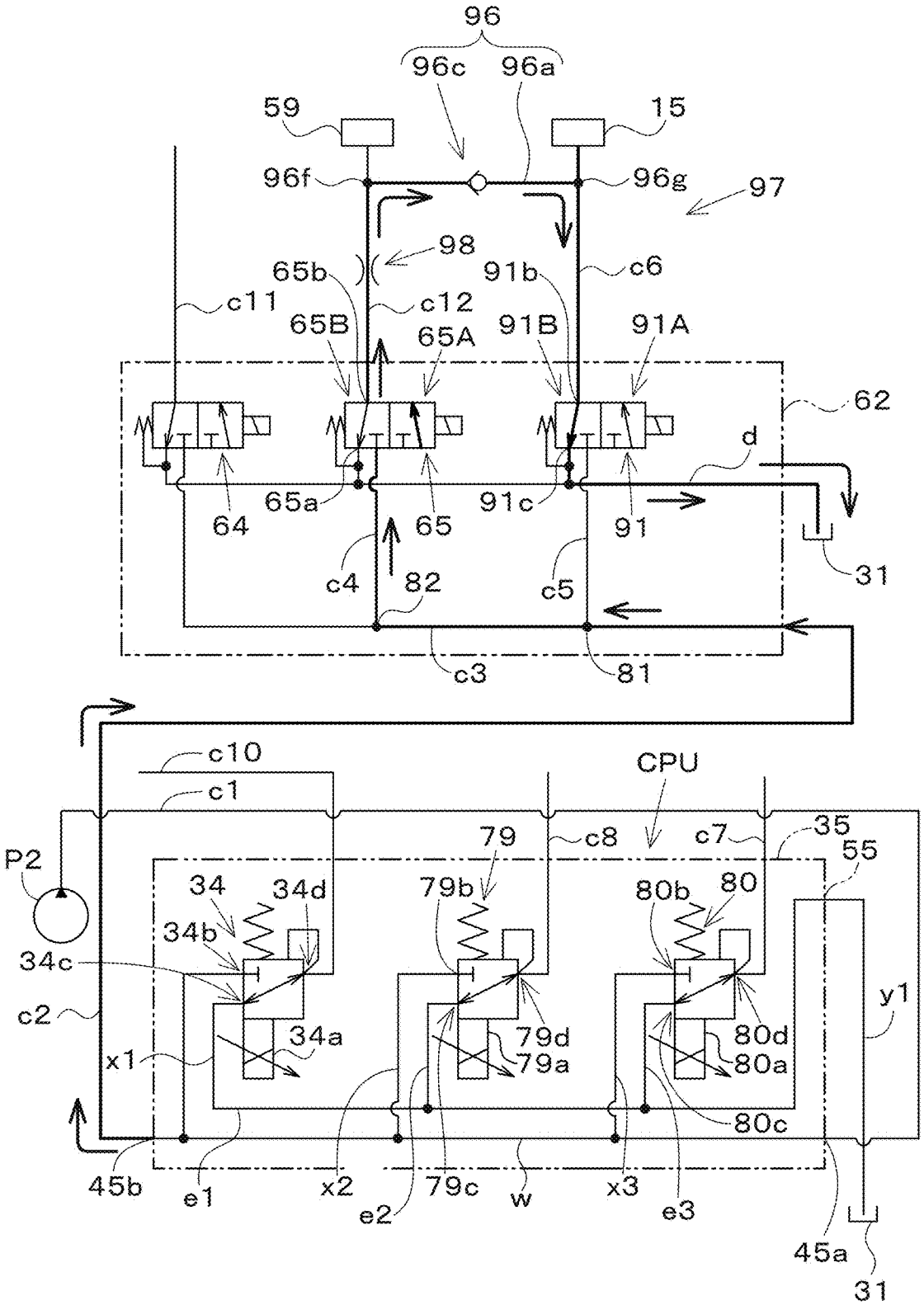
FIG. 6 illustrates a simplified hydraulic circuit according to a second preferred embodiment of the present invention.

FIG. 6 illustrates a hydraulic circuit according to a second preferred embodiment.

In the second preferred embodiment, a brake release valve is used as the first switching valve, and a work lock valve is used as the second switching valve.

As illustrated in FIG. 6, the return circuit 97 according to the second preferred embodiment has the connection circuit 96 that connects the twelfth hydraulic fluid passage c12 (i.e., a first fluid passage) between the brake release valve (i.e., a first switching valve) 65 and the brake cylinder (i.e., a first hydraulic device) 59 to the sixth hydraulic fluid passage (i.e., a second fluid passage) c6 between the work lock valve (i.e., a second switching valve) 91 and the work operation device (i.e., a second hydraulic device) 15.

The connection circuit 96 has the connection fluid passage 96*a* and the check valve 96*c* provided in the connection fluid passage 96*a*. The connection fluid passage 96*a* has one end connected to the twelfth hydraulic fluid passage c12 at a connection point 96*f* and the other end connected to the sixth hydraulic fluid passage c6 at a connection point 96*g*. The check valve 96*c* prevents the hydraulic fluid from flowing from the sixth hydraulic fluid passage c6 toward the twelfth hydraulic fluid passage c12. In the second preferred embodiment, the connection circuit 96 does not have a throttle. Instead, the twelfth hydraulic fluid passage c12 is provided with a throttle 98 between the connection point 96*f* and the brake release valve 65 (i.e., the valve block 62).

In the return circuit 97 according to the second preferred embodiment, the controller CU operates the brake release valve 65 (i.e., the first switching valve) to the open position 65A in a state where the work lock valve (i.e., the second switching valve) 91 is in the closed position 91B, so that the hydraulic fluid from the heat-up fluid passage w is returned to the hydraulic fluid tank 31 via the twelfth hydraulic fluid passage c12 (i.e., the first fluid passage), the connection circuit 96, and the work lock valve (i.e., the second switching valve) 91.

Specifically, when the engine 29 is started to activate the second pump P2 and the controller CU operates the brake release valve 65 to the open position 65A in a state where the work lock valve 91 is in the closed position 91B during a heat-up operation, the hydraulic fluid output from the second pump P2 and flowing into the heat-up fluid passage w flows through the heat-up fluid passage w, flows out from the heat-up fluid passage w, flows through the second hydraulic fluid passage c2 and the third hydraulic fluid passage c3 to reach the first port 65*a* of the brake release valve 65, and flows into the brake release valve 65 from the first port 65*a*. The hydraulic fluid flowing in from the first port 65*a* of the brake release valve 65 flows out from the second port 65*b*, flows to the sixth hydraulic fluid passage c6 from the twelfth hydraulic fluid passage c12 via the connection circuit 96, reaches the second port 91*b* of the work lock valve 91, and flows into the work lock valve 91 from the second port 91*b*. The hydraulic fluid flowing in from the second port 91*b* of the work lock valve 91 flows into the hydraulic fluid tank 31 from the drain port 91*c* of the work lock valve 91 via the drain passage d and the drain fluid passage y2.

Thus, the return circuit 97 according to the second preferred embodiment illustrated in FIG. 6 includes the second hydraulic fluid passage c2, the third hydraulic fluid passage c3, the fluid passage of the brake release valve 65, a portion of the twelfth hydraulic fluid passage c12, the connection circuit 96, a portion of the sixth hydraulic fluid passage c6, the fluid passage of the work lock valve 91, the drain passage d, and the drain fluid passage y2.

Other components of the second preferred embodiment are similar to those of the hydraulic system illustrated in FIG. 1 to FIG. 5 and the working machine illustrated in FIG. 13 and FIG. 14.

Figure 7:
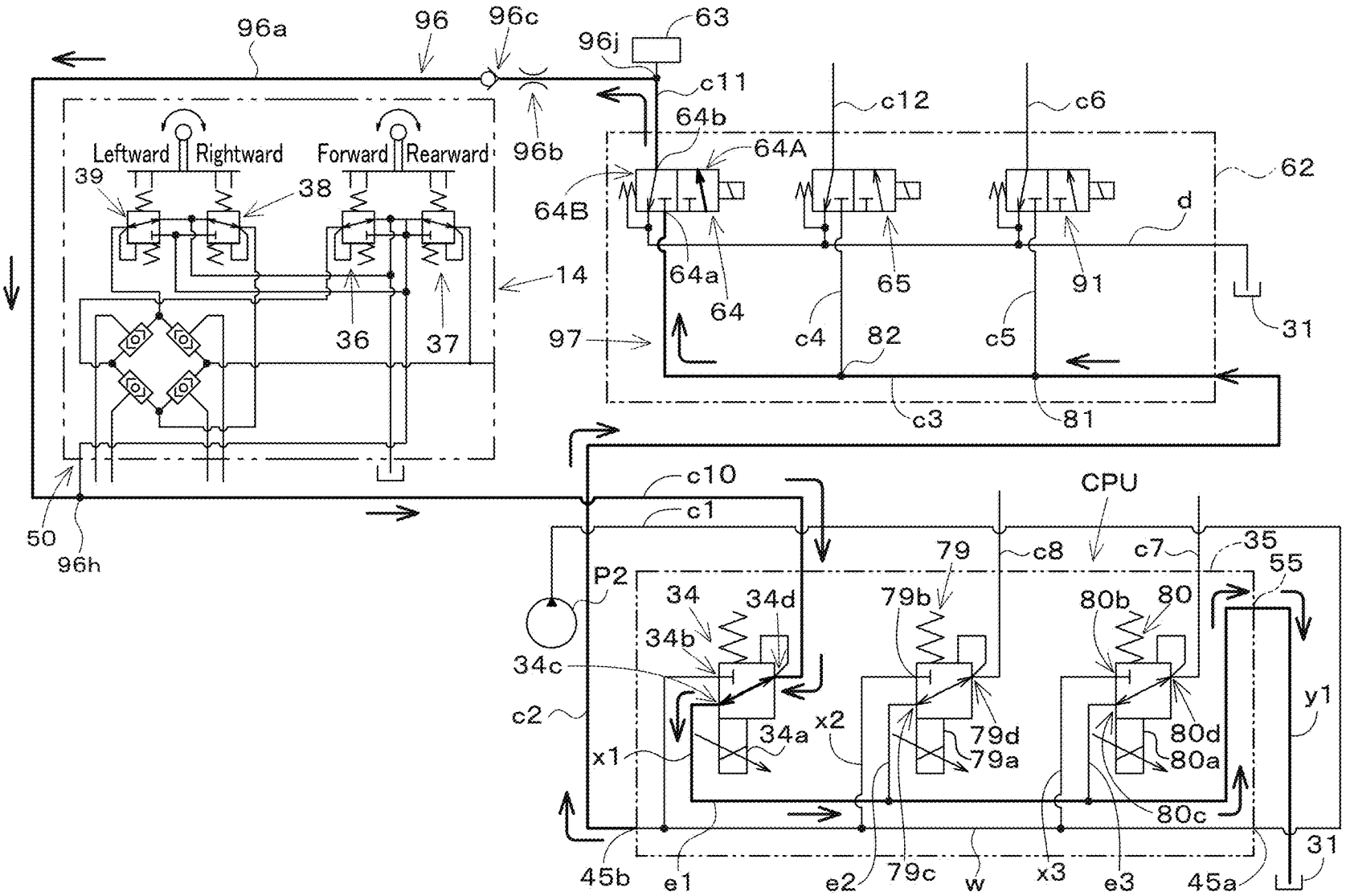
FIG. 7 illustrates a simplified hydraulic circuit according to a third preferred embodiment of the present invention.

FIG. 7 illustrates a hydraulic circuit according to a third preferred embodiment.

As illustrated in FIG. 7, the return circuit 97 according to the third preferred embodiment has the connection circuit 96 that connects the tenth hydraulic fluid passage (i.e., a supply fluid passage) c10, which supplies the hydraulic fluid from the traveling pressure control valve (i.e., a proportional valve) 34 to the travel operation device (i.e., a supply target) 14, to the eleventh hydraulic fluid passage (i.e., a fluid passage) c11, which supplies the hydraulic fluid from the second-speed switching valve (i.e., a switching valve) 64 to the cylinder switching valve (i.e., a hydraulic device) 63.

The connection circuit 96 has the connection fluid passage 96*a*, as well as the throttle 96*b* and the check valve 96*c* that are provided in the connection fluid passage 96*a*. The connection fluid passage 96*a* has one end connected to the tenth hydraulic fluid passage c10 at a connection point 96*h* and the other end connected to the eleventh hydraulic fluid passage c11 at a connection point 96*j*. The throttle 96*b* is provided between the connection point 96*j* and the check valve 96*c* (i.e., upstream of the check valve 96*c*). The check valve 96*c* prevents the hydraulic fluid from flowing from the tenth hydraulic fluid passage c10 toward the eleventh hydraulic fluid passage c11.

In the return circuit 97 according to the third preferred embodiment, the controller CU operates the second-speed switching valve (i.e., the switching valve) 64 to the open position 64A in a state where the traveling pressure control valve (i.e., the proportional valve) 34 is closed, so that the hydraulic fluid from the heat-up fluid passage w is returned to the hydraulic fluid tank 31 via the eleventh hydraulic fluid passage (i.e., the fluid passage) c11, the connection circuit 96, the tenth hydraulic fluid passage (i.e., the supply fluid passage) c10, and the traveling pressure control valve (i.e., the proportional valve) 34.

Specifically, when the engine 29 is started to activate the second pump P2 and the controller CU operates the second-speed switching valve 64 to the open position 64A in a state where the traveling pressure control valve 34 is closed during a heat-up operation, the hydraulic fluid output from the second pump P2 and flowing into the heat-up fluid passage w flows through the heat-up fluid passage w, flows out from the heat-up fluid passage w, flows through the second hydraulic fluid passage c2 and the third hydraulic fluid passage c3 to reach the first port 64*a* of the second-speed switching valve 64, and flows into the second-speed switching valve 64 from the first port 64*a*. The hydraulic fluid flowing in from the first port 64*a* of the second-speed switching valve 64 flows out from the second port 64*b*, flows to the tenth hydraulic fluid passage c10 from the eleventh hydraulic fluid passage c11 via the connection circuit 96, reaches the secondary port 34*d* of the traveling pressure control valve 34, and flows into the traveling pressure control valve 34 from the secondary port 34*d*. The hydraulic fluid flowing in from the secondary port 34*d* of the traveling pressure control valve 34 flows out from the tank port 34*c* of the traveling pressure control valve 34 and flows into the hydraulic fluid tank 31 via the drain passage e1 and the drain fluid passage y1.

Thus, the return circuit 97 according to the third preferred embodiment illustrated in FIG. 7 includes the second hydraulic fluid passage c2, the third hydraulic fluid passage c3, the fluid passage of the second-speed switching valve 64, a portion of the eleventh hydraulic fluid passage c11, the connection circuit 96, a portion of the tenth hydraulic fluid passage c10, the fluid passage of the traveling pressure control valve 34, the drain passage e1, and the drain fluid passage y1.

In the third preferred embodiment, the tank port 34*c* can also be heated up together with the primary port 34*b* of the traveling pressure control valve (i.e., the proportional valve) 34 that communicates with the heat-up fluid passage w. Furthermore, since the tenth hydraulic fluid passage c10 that supplies the hydraulic fluid from the traveling pressure control valve 34 to the travel operation device 14 can also be heated up, the responsiveness of the travel operation device 14 can be ensured during a low-temperature state, thereby preventing an engine stall caused by a delayed response of the traveling pressure control valve 34.

Other components of the third preferred embodiment are similar to those of the hydraulic system illustrated in FIG. 1 to FIG. 5 and the working machine illustrated in FIG. 13 and FIG. 14.

Figure 8:
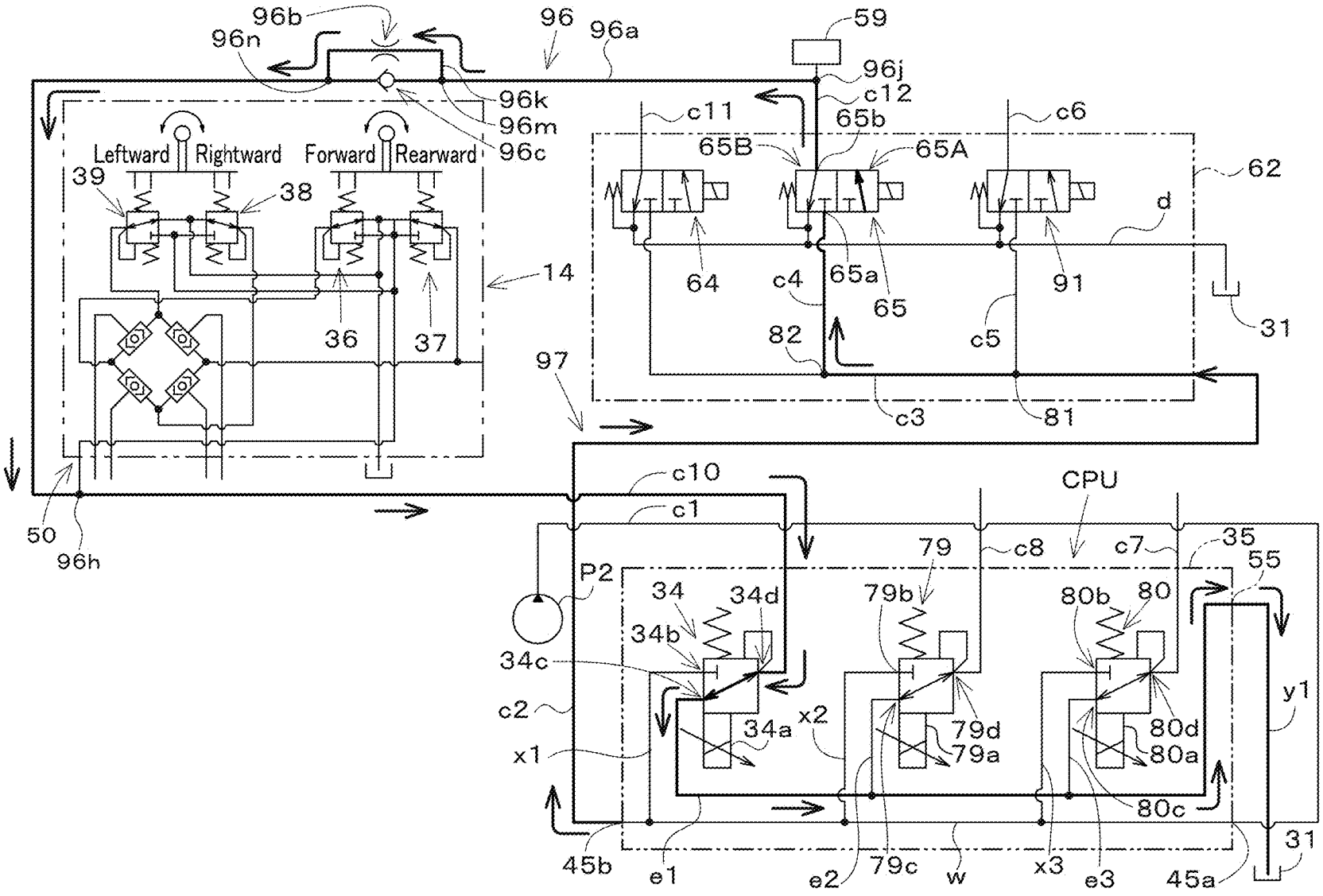
FIG. 8 illustrates a simplified hydraulic circuit according to a fourth preferred embodiment of the present invention.

FIG. 8 illustrates a hydraulic circuit according to a fourth preferred embodiment.

As illustrated in FIG. 8, the return circuit 97 according to the fourth preferred embodiment has the connection circuit 96 that connects the tenth hydraulic fluid passage (i.e., a supply fluid passage) c10, which supplies the hydraulic fluid from the traveling pressure control valve (i.e., a proportional valve) 34 to the travel operation device (i.e., a supply target) 14, to the twelfth hydraulic fluid passage (i.e., a fluid passage) c12, which supplies the hydraulic fluid from the brake release valve (i.e., a switching valve) 65 to the brake cylinder (i.e., a hydraulic device) 59.

The connection circuit 96 has the connection fluid passage 96*a*, the check valve 96*c* provided in the connection fluid passage 96*a*, a bypass fluid passage 96*k* that bypasses the check valve 96*c*, and the throttle 96*b* provided in the bypass fluid passage 96*k*. The connection fluid passage 96*a* has one end connected to the tenth hydraulic fluid passage c10 at the connection point 96*h* and the other end connected to the twelfth hydraulic fluid passage c12 at the connection point 96*j*. The check valve 96*c* prevents the hydraulic fluid from flowing from the twelfth hydraulic fluid passage c12 toward the tenth hydraulic fluid passage c10. The bypass fluid passage 96*k* has one end connected to the connection fluid passage 96*a* at a connection point 96*m* (i.e., upstream of the check valve 96*c*) and the other end connected to the connection fluid passage 96*a* at a connection point 96*n* (i.e., downstream of the check valve 96*c*).

In the return circuit 97 according to the fourth preferred embodiment, the controller CU operates the brake release valve (i.e., the switching valve) 65 to the open position 65A in a state where the traveling pressure control valve (i.e., the proportional valve) 34 is closed, so that the hydraulic fluid from the heat-up fluid passage w is returned to the hydraulic fluid tank 31 via the twelfth hydraulic fluid passage (i.e., the fluid passage) c12, the connection circuit 96, the tenth hydraulic fluid passage (i.e., the supply fluid passage) c10, and the traveling pressure control valve (i.e., the proportional valve) 34.

Specifically, when the engine 29 is started to activate the second pump P2 and the controller CU operates the brake release valve (i.e., the switching valve) 65 to the open position 65A in a state where the traveling pressure control valve 34 is closed during a heat-up operation, the hydraulic fluid output from the second pump P2 and flowing into the heat-up fluid passage w flows through the heat-up fluid passage w, flows out from the heat-up fluid passage w, flows through the second hydraulic fluid passage c2 and the third hydraulic fluid passage c3 to reach the first port 65*a* of the brake release valve 65, and flows into the brake release valve 65 from the first port 65*a*. The hydraulic fluid flowing in from the first port 65*a* of the brake release valve 65 flows out from the second port 65*b*, flows to the tenth hydraulic fluid passage c10 from the twelfth hydraulic fluid passage c12 via the connection circuit 96, reaches the secondary port 34*d* of the traveling pressure control valve 34, and flows into the traveling pressure control valve 34 from the secondary port 34*d*. The hydraulic fluid flowing in from the secondary port 34*d* of the traveling pressure control valve 34 flows out from the tank port 34*c* of the traveling pressure control valve 34 and flows into the hydraulic fluid tank 31 via the drain passage e1 and the drain fluid passage y1.

Thus, the return circuit 97 according to the fourth preferred embodiment illustrated in FIG. 8 includes the second hydraulic fluid passage c2, the third hydraulic fluid passage c3, the fluid passage of the brake release valve 65, a portion of the twelfth hydraulic fluid passage c12, the connection circuit 96, a portion of the tenth hydraulic fluid passage c10, the fluid passage of the traveling pressure control valve 34, the drain passage e1, and the drain fluid passage y1.

In the fourth preferred embodiment, when the hydraulic fluid is to flow into the tenth hydraulic fluid passage c10 from the twelfth hydraulic fluid passage c12 via the connection circuit 96, the hydraulic fluid flows from the connection point 96*m* to the connection point 96*n* via the bypass fluid passage 96*k*.

Furthermore, the set pressure of the traveling pressure control valve (i.e., the proportional valve) 34 is lower than the set pressure of the brake release valve (i.e., the switching valve) 65. In the fourth preferred embodiment, the tank port 34*c* can be similarly heated up together with the primary port 34*b* of the traveling pressure control valve (i.e., the proportional valve) 34 that communicates with the heat-up fluid passage w.

As an alternative to the fourth preferred embodiment in which the brake release valve 65 is used as the switching valve, the switching valve may be the work lock valve 91 or the second-speed switching valve 64.

Other components of the fourth preferred embodiment are similar to those of the hydraulic system illustrated in FIG. 1 to FIG. 5 and the working machine illustrated in FIG. 13 and FIG. 14.

Figure 9:
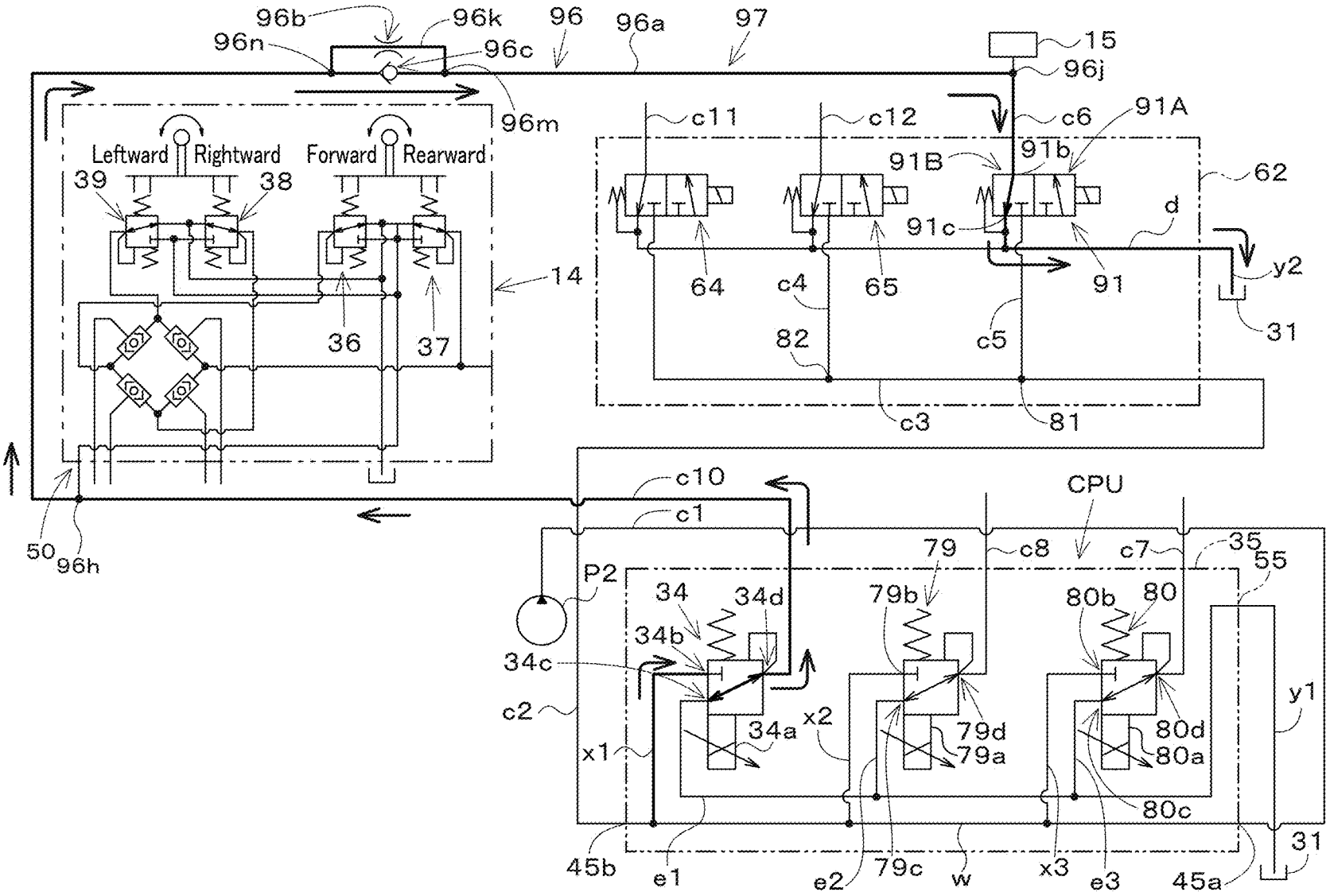
FIG. 9 illustrates a simplified hydraulic circuit according to a fifth preferred embodiment of the present invention.

FIG. 9 illustrates a hydraulic circuit according to a fifth preferred embodiment.

As illustrated in FIG. 9, the return circuit 97 according to the fifth preferred embodiment has the connection circuit 96 that connects the tenth hydraulic fluid passage (i.e., a supply fluid passage) c10, which supplies the hydraulic fluid from the traveling pressure control valve (i.e., a proportional valve) 34 to the travel operation device (i.e., a supply target) 14, to the sixth hydraulic fluid passage (i.e., a fluid passage) c6, which supplies the hydraulic fluid from the work lock valve (i.e., a switching valve) 91 to the work operation device (i.e., a hydraulic device) 15.

The connection circuit 96 has the connection fluid passage 96*a*, the check valve 96*c* provided in the connection fluid passage 96*a*, the bypass fluid passage 96*k* that bypasses the check valve 96*c*, and the throttle 96*b* provided in the bypass fluid passage 96*k*. The connection fluid passage 96*a* has one end connected to the tenth hydraulic fluid passage c10 at the connection point 96*h* and the other end connected to the sixth hydraulic fluid passage c6 at the connection point 96*j*. The check valve 96*c* prevents the hydraulic fluid from flowing from the sixth hydraulic fluid passage c6 toward the tenth hydraulic fluid passage c10. The bypass fluid passage 96*k* has one end connected to the connection fluid passage 96*a* at the connection point 96*m* (i.e., downstream of the check valve 96*c*) and the other end connected to the connection fluid passage 96*a* at the connection point 96*n* (i.e., upstream of the check valve 96*c*).

In the return circuit 97 according to the fifth preferred embodiment, the controller CU opens the traveling pressure control valve (i.e., the proportional valve) 34 in a state where the work lock valve (i.e., the switching valve) 91 is in the closed position 91B, so that the hydraulic fluid flowing in from the heat-up fluid passage w is returned to the hydraulic fluid tank 31 via the traveling pressure control valve (i.e., the proportional valve) 34, the tenth hydraulic fluid passage (i.e., the supply fluid passage) c10, the connection circuit 96, the sixth hydraulic fluid passage (i.e., the fluid passage) c6, and the work lock valve (i.e., the switching valve) 91.

Specifically, when the engine 29 is started to activate the second pump P2 and the controller CU opens the traveling pressure control valve 34 in a state where the work lock valve 91 is in the closed position 91B during a heat-up operation, the hydraulic fluid output from the second pump P2 and flowing into the heat-up fluid passage w flows to the primary port 34*b* of the traveling pressure control valve 34 from the branch fluid passage x1 and flows out from the secondary port 34*d*. The hydraulic fluid flowing out from the secondary port 34*d* of the traveling pressure control valve 34 reaches the second port 91*b* of the work lock valve 91 from the tenth hydraulic fluid passage c10 via the connection circuit 96 and the sixth hydraulic fluid passage c6, and flows into the work lock valve 91 from the second port 91*b*. The hydraulic fluid flowing in from the second port 91*b* of the work lock valve 91 is discharged from the drain port 91*c* of the work lock valve 91 and flows into the hydraulic fluid tank 31 via the drain passage d and the drain fluid passage y2.

Thus, the return circuit 97 according to the fifth preferred embodiment illustrated in FIG. 9 includes the branch fluid passage x1, the fluid passage of the traveling pressure control valve 34, a portion of the tenth hydraulic fluid passage c10, the connection circuit 96, a portion of the sixth hydraulic fluid passage c6, the fluid passage of the work lock valve 91, the drain passage d, and the drain fluid passage y2.

In the fifth preferred embodiment, the set pressure of the traveling pressure control valve (i.e., the proportional valve) 34 is higher than the set pressure of the work lock valve (i.e., the switching valve) 91. Of the plurality of (i.e., three) proportional valves, the traveling pressure control valve 34 defining and functioning as the proportional valve that supplies the hydraulic fluid to the supply target (i.e., the travel operation device 14) through the supply fluid passage (i.e., the tenth hydraulic fluid passage c10) is disposed at a downstream-most location of the heat-up fluid passage w.

As an alternative to the fifth preferred embodiment in which the work lock valve 91 is used as the switching valve, the switching valve may be the brake release valve 65 or the second-speed switching valve 64.

Other components of the fifth preferred embodiment are similar to those of the hydraulic system illustrated in FIG. 1 to FIG. 5 and the working machine illustrated in FIG. 13 and FIG. 14.

Figure 10:
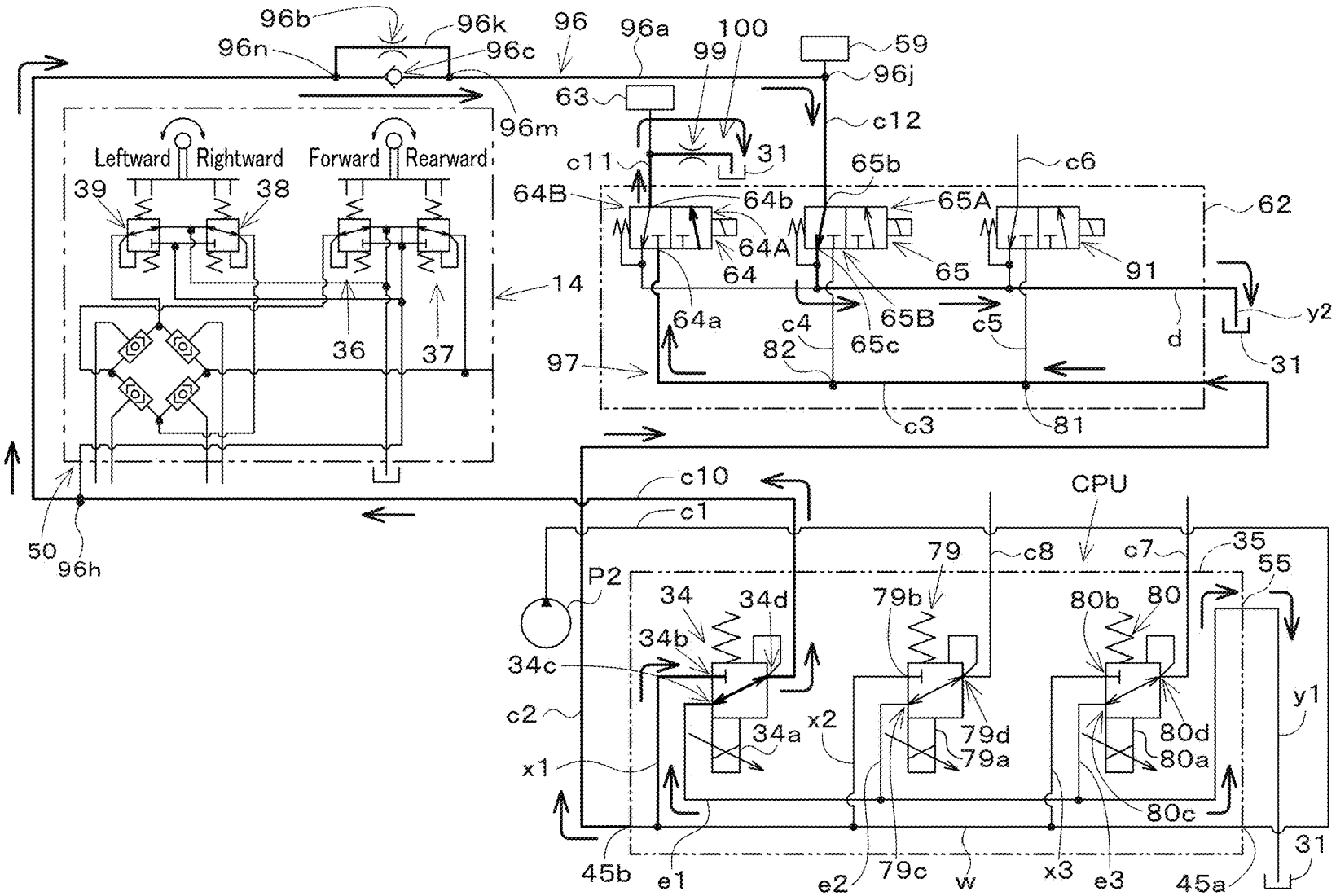
FIG. 10 illustrates a simplified hydraulic circuit according to a sixth preferred embodiment of the present invention.

FIG. 10 illustrates a hydraulic circuit according to a sixth preferred embodiment.

As illustrated in FIG. 10, the return circuit 97 according to the sixth preferred embodiment has a bleed circuit 100. The bleed circuit 100 has a throttle 99 and is connected to the eleventh hydraulic fluid passage (i.e., a third fluid passage) c11 between the second-speed switching valve (i.e., a third switching valve) 64 and the cylinder switching valve (i.e., a third hydraulic device) 63. The controller CU operates the second-speed switching valve 64 (i.e., the third switching valve) to an open position, so that the hydraulic fluid from the heat-up fluid passage w flows into the hydraulic fluid tank 31 from the eleventh hydraulic fluid passage (i.e., the third fluid passage) c11 via the throttle 99.

Furthermore, the return circuit 97 according to the sixth preferred embodiment has the connection circuit 96 that connects the twelfth hydraulic fluid passage (i.e., a fourth fluid passage) c12 between the brake release valve (i.e., a fourth switching valve) 65 and the brake cylinder (i.e., a fourth hydraulic device) 59 to the tenth hydraulic fluid passage (i.e., a supply fluid passage) c10 that supplies the hydraulic fluid from the traveling pressure control valve (i.e., a proportional valve) 34 to the travel operation device (i.e., a supply target) 14.

The connection circuit 96 has the connection fluid passage 96*a*, the check valve 96*c* provided in the connection fluid passage 96*a*, the bypass fluid passage 96*k* that bypasses the check valve 96*c*, and the throttle 96*b* provided in the bypass fluid passage 96*k*. The connection fluid passage 96*a* has one end connected to the tenth hydraulic fluid passage c10 at the connection point 96*h* and the other end connected to the twelfth hydraulic fluid passage c12 at the connection point 96*j*. The check valve 96*c* prevents the hydraulic fluid from flowing from the twelfth hydraulic fluid passage c12 toward the tenth hydraulic fluid passage c10. The bypass fluid passage 96*k* has one end connected to the connection fluid passage 96*a* at the connection point 96*m* (i.e., downstream of the check valve 96*c*) and the other end connected to the connection fluid passage 96*a* at the connection point 96*n* (i.e., upstream of the check valve 96*c*).

In the return circuit 97 according to the sixth preferred embodiment, the controller CU operates the second-speed switching valve (i.e., the third switching valve) 64 to the open position 64A and opens the traveling pressure control valve (i.e., the proportional valve) 34 in a state where the brake release valve (i.e., the fourth switching valve) 65 is in the closed position 65B, so that the hydraulic fluid from the heat-up fluid passage w is returned to the hydraulic fluid tank 31 via the bleed circuit 100, the traveling pressure control valve (i.e., the proportional valve) 34, the tenth hydraulic fluid passage (i.e., the supply fluid passage) c10, the connection circuit 96, the twelfth hydraulic fluid passage (i.e., the fourth fluid passage) c12, and the brake release valve (i.e., the fourth switching valve) 65.

Specifically, when the engine 29 is started to activate the second pump P2 and the controller CU operates the second-speed switching valve 64 to the open position 64A during a heat-up operation, the hydraulic fluid output from the second pump P2 and flowing into the heat-up fluid passage w flows through the heat-up fluid passage w, flows out from the heat-up fluid passage w, flows through the second hydraulic fluid passage c2 and the third hydraulic fluid passage c3 to reach the first port 64*a* of the second-speed switching valve 64, and flows into the second-speed switching valve 64 from the first port 64*a*. The hydraulic fluid flowing in from the first port 64*a* of the second-speed switching valve 64 flows out to the eleventh hydraulic fluid passage c11 from the second port 64*b* and flows into the hydraulic fluid tank 31 from the eleventh hydraulic fluid passage c11 via the bleed circuit 100.

Furthermore, when the traveling pressure control valve 34 is opened in a state where the brake release valve 65 is in the closed position 65B, the hydraulic fluid output from the second pump P2 and flowing into the heat-up fluid passage w flows into the primary port 34*b* of the traveling pressure control valve 34 from the branch fluid passage x1 and flows out from the secondary port 34*d*. The hydraulic fluid flowing out from the secondary port 34*d* of the traveling pressure control valve 34 reaches the second port 65*b* of the brake release valve 65 from the tenth hydraulic fluid passage c10 via the connection circuit 96 and the twelfth hydraulic fluid passage c12 and flows into the brake release valve 65 from the second port 65*b*. The hydraulic fluid flowing in from the second port 65*b* of the brake release valve 65 is discharged from the drain port 65*c* of the brake release valve 65 and flows into the hydraulic fluid tank 31 via the drain passage d and the drain fluid passage y2.

Thus, the return circuit 97 according to the sixth preferred embodiment illustrated in FIG. 10 includes the second hydraulic fluid passage c2, the third hydraulic fluid passage c3, the fluid passage of the second-speed switching valve 64, a portion of the eleventh hydraulic fluid passage c11, the bleed circuit 100, the branch fluid passage x1, the fluid passage of the traveling pressure control valve 34, a portion of the tenth hydraulic fluid passage c10, the connection circuit 96, a portion of the twelfth hydraulic fluid passage c12, the fluid passage of the brake release valve 65, the drain passage d, and the drain fluid passage y2.

In the sixth preferred embodiment, the set pressure of the traveling pressure control valve (i.e., the proportional valve) 34 is higher than the set pressure of the brake release valve (i.e., the fourth switching valve) 65. Of the plurality of (i.e., three) proportional valves, the traveling pressure control valve 34 defining and functioning as the proportional valve that supplies the hydraulic fluid to the supply target (i.e., the travel operation device 14) through the supply fluid passage (i.e., the tenth hydraulic fluid passage c10) is disposed at a downstream-most location of the heat-up fluid passage w.

Although the second-speed switching valve 64 is used as the third switching valve and the brake release valve 65 is used as the fourth switching valve in the sixth preferred embodiment, the configuration is not limited to this. For example, as an alternative to the brake release valve 65 being used as the fourth switching valve, the work lock valve 91 may be used as the fourth switching valve.

Other components of the sixth preferred embodiment are similar to those of the hydraulic system illustrated in FIG. 1 to FIG. 5 and the working machine illustrated in FIG. 13 and FIG. 14.

Figure 11:
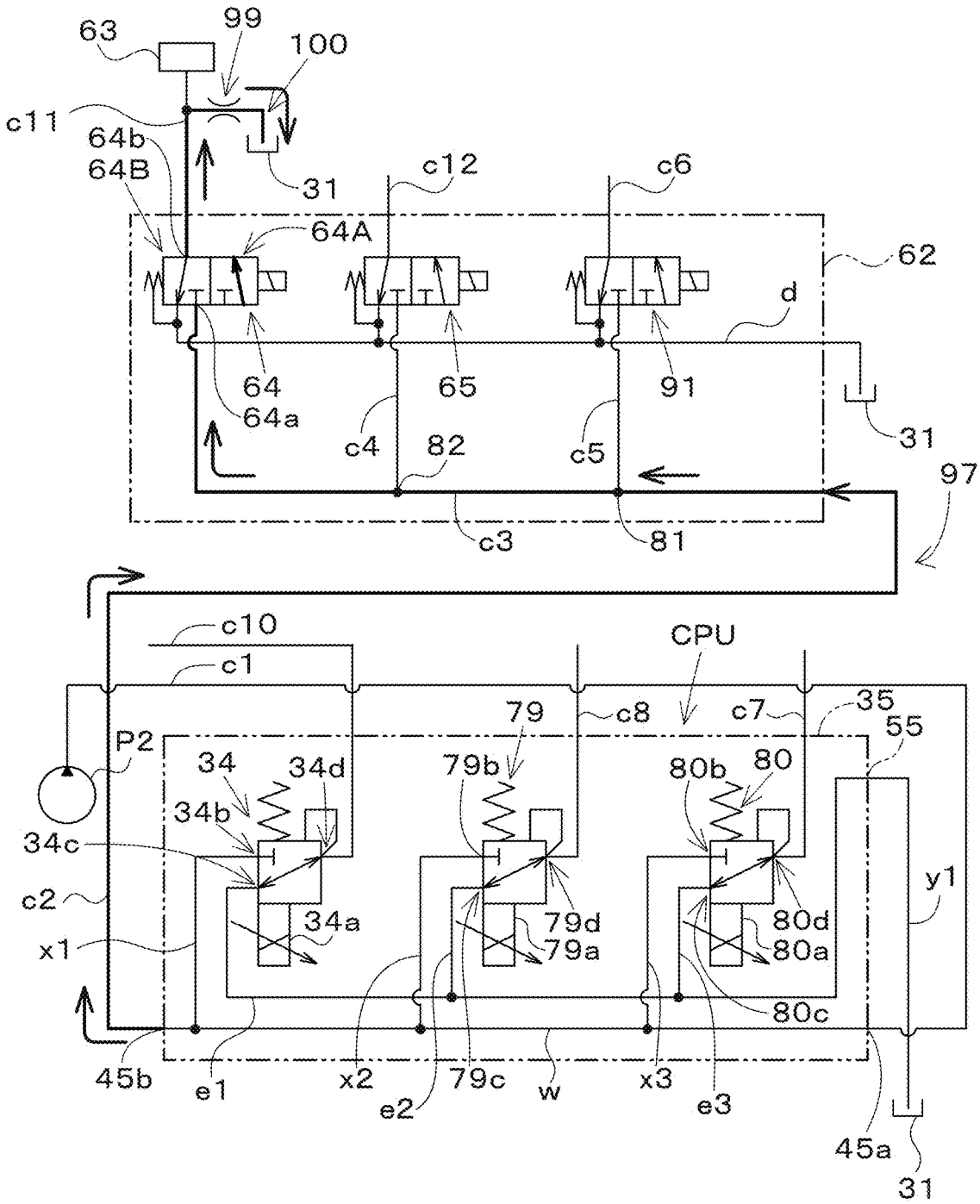
FIG. 11 illustrates a simplified hydraulic circuit according to a seventh preferred embodiment of the present invention.

FIG. 11 illustrates a hydraulic circuit according to a seventh preferred embodiment.

As illustrated in FIG. 11, the return circuit 97 according to the seventh preferred embodiment has the bleed circuit 100. The bleed circuit 100 has the throttle 99 and is connected to the eleventh hydraulic fluid passage (i.e., a fluid passage) c11 between the second-speed switching valve (i.e., a switching valve) 64 and the cylinder switching valve (i.e., a hydraulic device) 63. The controller CU operates the second-speed switching valve (i.e., the switching valve) 64 to an open position, so that the hydraulic fluid from the heat-up fluid passage w flows into the hydraulic fluid tank 31 from the eleventh hydraulic fluid passage (i.e., the fluid passage) c11 via the throttle 99.

Other components of the seventh preferred embodiment are similar to those of the hydraulic system illustrated in FIG. 1 to FIG. 5 and the working machine illustrated in FIG. 13 and FIG. 14.

Figure 12A:
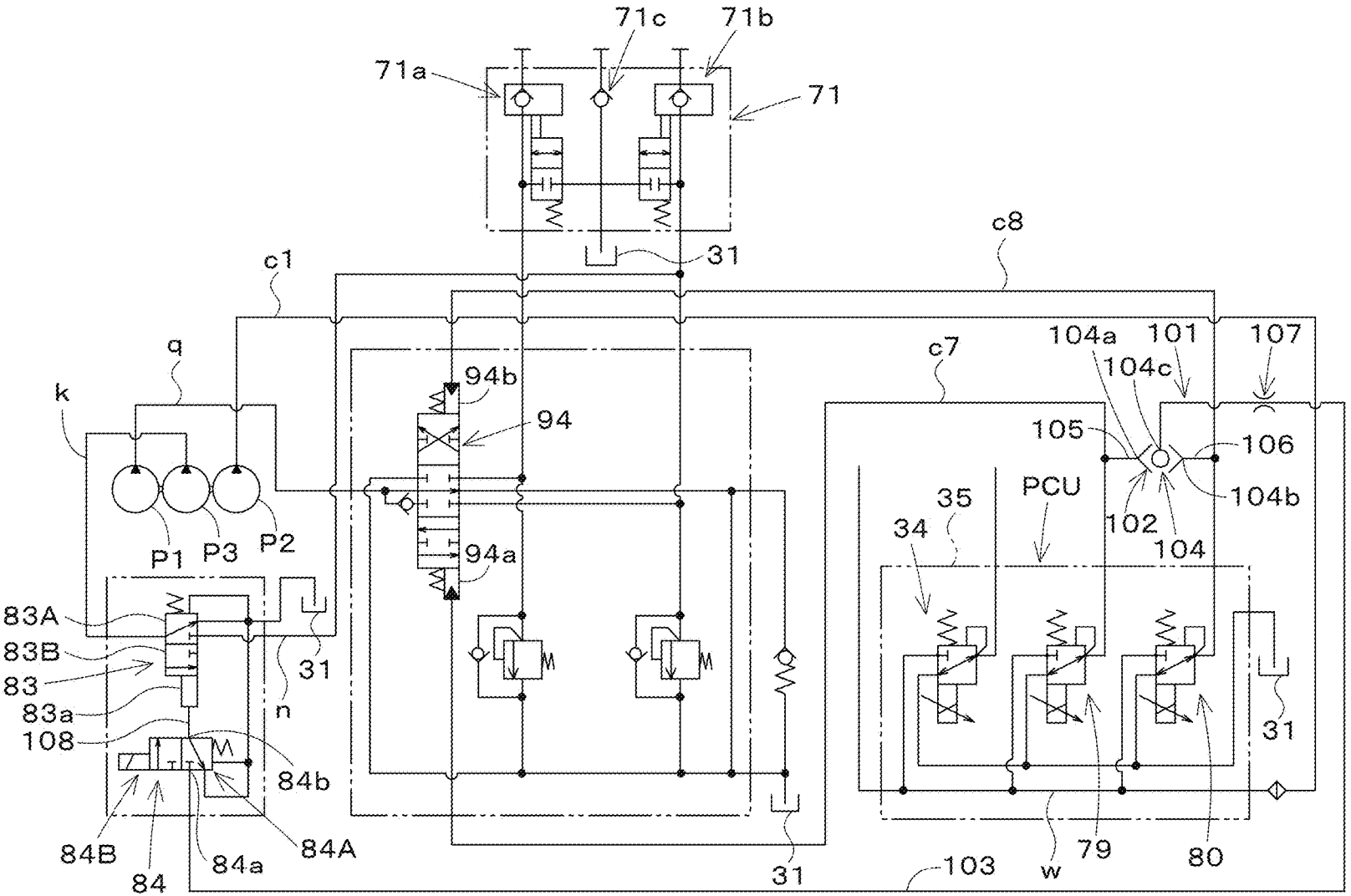
FIG. 12A illustrates a hydraulic circuit according to a modification of a hydraulic system according to a preferred embodiment of the present invention.

FIG. 12A illustrates a hydraulic circuit according to a modification of the hydraulic system.

The hydraulic circuit illustrated in FIG. 12A has a high-flow switching circuit 101 that applies fluid pressure (i.e., pilot pressure) output from the SP operation valve 79 or the SP operation valve 80 to a pressure receiver 83*a* of the high flow valve 83.

As illustrated in FIG. 12A, the high-flow switching circuit 101 has a fluid-pressure extracting circuit 102, a supply line 103, a throttle 107, and a supply passage 108.

The fluid-pressure extracting circuit 102 connects the seventh hydraulic fluid passage c7 and the eighth hydraulic fluid passage c8 and extracts the pilot pressure output from the SP operation valve 79 or the SP operation valve 80. Specifically, the fluid-pressure extracting circuit 102 has a shuttle valve 104, a first connection passage 105 that connects a first input port 104*a* of the shuttle valve 104 and the seventh hydraulic fluid passage c7, and a second connection passage 106 that connects a second input port 104*b* of the shuttle valve 104 and the eighth hydraulic fluid passage c8, and extracts the pilot pressure from one of the seventh hydraulic fluid passage c7 and the eighth hydraulic fluid passage c8 and outputs the pilot pressure from an output port 104*c*.

The supply line 103 delivers the pilot pressure extracted by the fluid-pressure extracting circuit 102 to an inlet port 84*a* of the switching valve 84. Specifically, one end of the supply line 103 is connected to the output port 104*c* of the shuttle valve 104, and the other end of the supply line 103 is connected to the inlet port 84*a* of the switching valve 84.

The throttle 107 is provided in the supply line 103. The supply passage 108 has one end connected to an outlet port 84*b* of the switching valve 84 and the other end connected to the pressure receiver 83*a* of the high flow valve 83.

The switching valve 84 is switchable between a first position 84A in which the pilot pressure is not applied to the pressure receiver 83*a* of the high flow valve 83 and a second position 84B in which the pilot pressure is applied to the pressure receiver 83*a* of the high flow valve 83. When the switching valve 84 is switched to the second position 84B, the inlet port 84*a* and the outlet port 84*b* communicate with each other, so that the pilot pressure output from the SP operation valve 79 or the SP operation valve 80 is applied to the pressure receiver 83*a* of the high flow valve 83 via the supply line 103, the throttle 107, the inlet port 84*a* and the outlet port 84*b* of the switching valve 84, and the supply passage 108, whereby the high flow valve 83 is switched from a non-increase position 83A to an increase position 83B.

According to the high-flow switching circuit 101 described above, the hydraulic fluid from the third pump P3 always starts to flow to the joint 71*b* of the hydraulic-hose-connection joint unit 71 after the SP operation valves 79 and 80 open. Accordingly, a phenomenon where the hydraulic fluid from the third pump P3 starts to flow to the joint unit 71 before the SP operation valves 79 and 80 open can be prevented.

The fluid-pressure extracting circuit 102 is preferably provided near the SP operation valves 79 and 80.

Figure 12B:
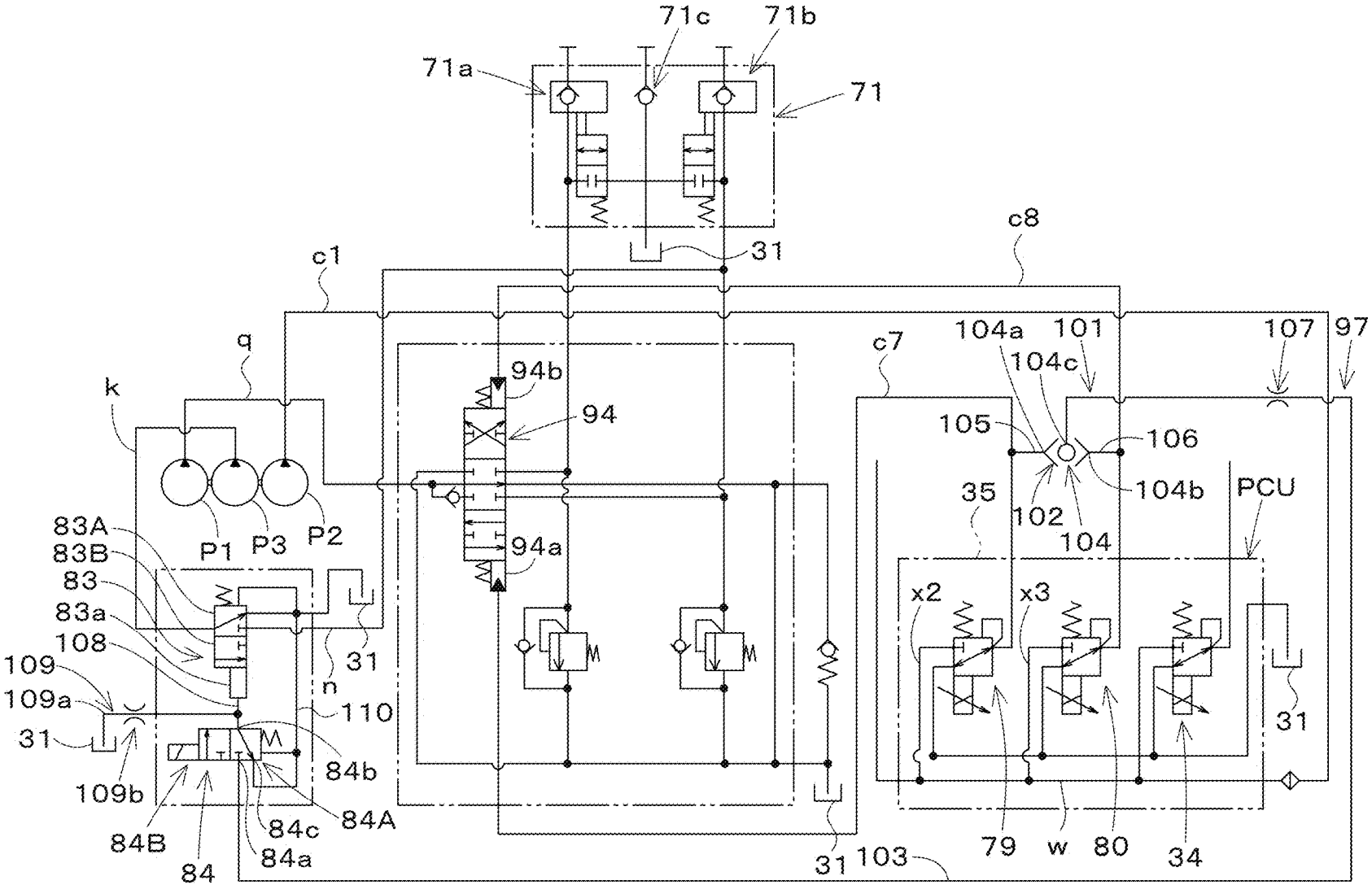
FIG. 12B illustrates a hydraulic circuit according to a modification of a hydraulic system according to a preferred embodiment of the present invention.

FIG. 12B illustrates a hydraulic circuit according to a modification of the hydraulic system.

With regard to the description of the hydraulic circuit illustrated in FIG. 12B, the differences from the hydraulic circuit illustrated in FIG. 12A will be described, whereas descriptions about identical components will be omitted.

In the hydraulic circuit illustrated in FIG. 12B, the SP operation valve 79 is disposed at a downstream-most location of the heat-up fluid passage w. Alternatively, the SP operation valve 80 may be disposed at the downstream-most location of the heat-up fluid passage w.

Furthermore, the supply passage 108 is connected to a bleed circuit 109. The bleed circuit 109 has a bleed fluid passage 109*a* having one end connected to the supply passage 108 and the other end communicating with the hydraulic fluid tank 31, and also has a throttle 109*b* provided in the bleed fluid passage 109*a*.

In the hydraulic circuit illustrated in FIG. 12B, when a heat-up operation is to be performed, the switching valve 84 is switched from the first position (i.e., a closed position) 84A to the second position (i.e., an open position) 84B in a state where the pressure in the SP operation valve 79 or the SP operation valve 80 is slightly increased, so that the hydraulic fluid flowing into the heat-up fluid passage w can flow into the hydraulic fluid tank 31 via the SP operation valve 79 or the SP operation valve 80, the fluid-pressure extracting circuit 102, the supply line 103, the switching valve 84, and the bleed circuit 109.

The aforementioned state where the pressure in the SP operation valve 79 or the SP operation valve 80 is slightly increased specifically refers to a state where the pressure has exceeded zero and is set below a pressure value at which the SP control valve 94 is to be switched.

Specifically, in the hydraulic circuit illustrated in FIG. 12B, for example, the SP operation valve 79, the SP operation valve 80, the fluid-pressure extracting circuit 102, the supply line 103, the switching valve 84, and the bleed circuit 109 constitute the return circuit 97.

Figure 12C:
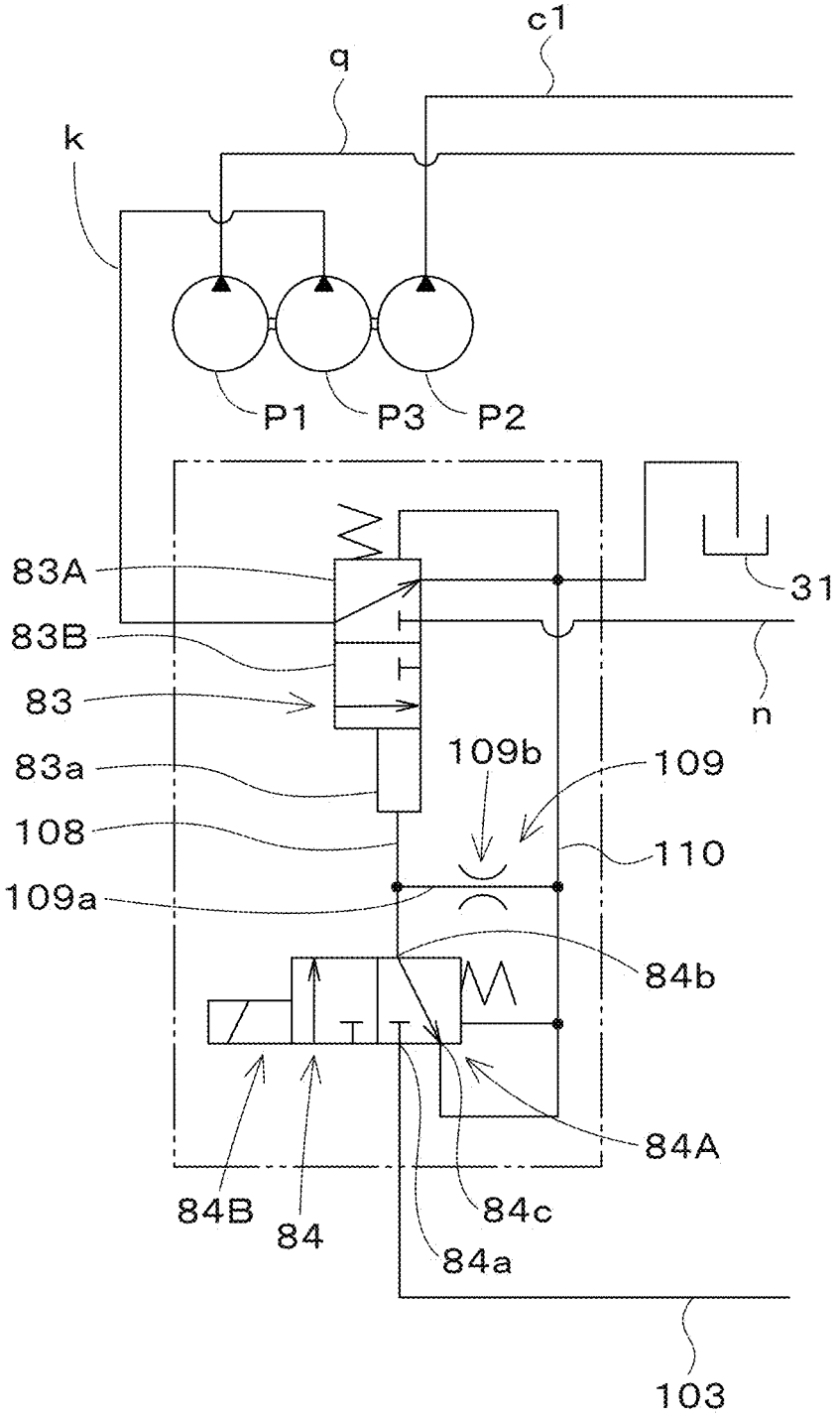
FIG. 12C illustrates a hydraulic circuit according to a modification of a hydraulic system according to a preferred embodiment of the present invention.

In the hydraulic circuit illustrated in FIG. 12B, the bleed circuit 109 may connect the supply passage 108 to a communication fluid passage 110 that allows a tank port 84*c* of the switching valve 84 to communicate with the hydraulic fluid tank 31. Specifically, as illustrated in FIG. 12C, the bleed circuit 109 may have one end connected to the supply passage 108 and the other end connected to the communication fluid passage 110.

Figure 12D:
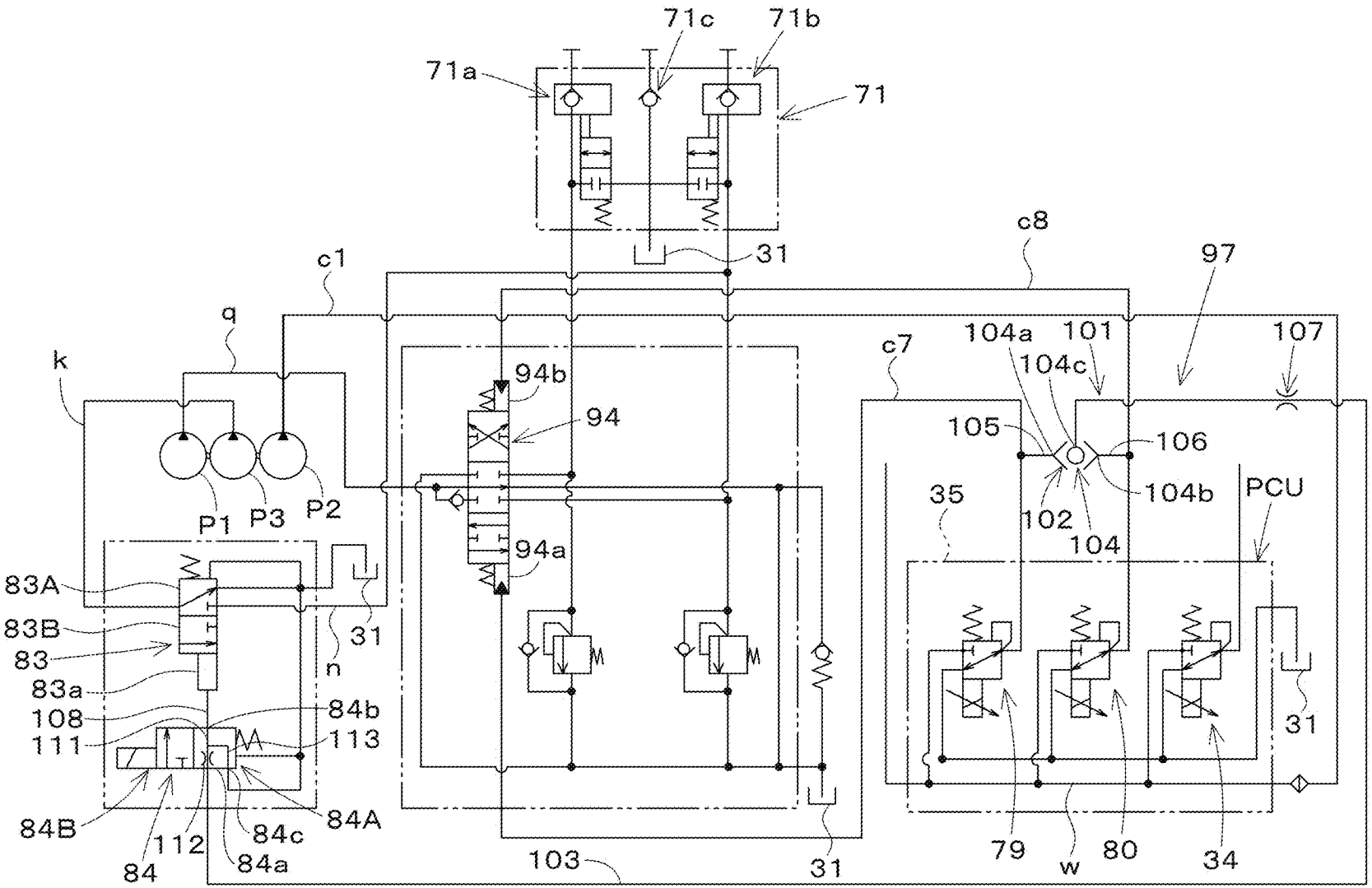
FIG. 12D illustrates a hydraulic circuit according to a modification of a hydraulic system according to a preferred embodiment of the present invention.

FIG. 12D illustrates a hydraulic circuit according to a modification of the hydraulic system.

With regard to the description of the hydraulic circuit illustrated in FIG. 12D, the differences from the hydraulic circuit illustrated in FIG. 12B will be described, whereas descriptions about identical components will be omitted.

In the hydraulic circuit illustrated in FIG. 12D, the switching valve 84 has a throttle 112 provided in a communication passage 111 that allows the inlet port 84*a* and the outlet port 84*b* to communicate with each other in the first position 84A, and also has a flow fluid passage 113 that branches off from between the throttle 112 in the communication passage 111 and the outlet port 84*b* and that communicates with the tank port 84*c*.

In the hydraulic circuit illustrated in FIG. 12D, when a heat-up operation is to be performed, if the SP operation valve 79 or the SP operation valve 80 is opened while the switching valve 84 is in the first position 84A, the hydraulic fluid flowing into the heat-up fluid passage w can flow into the hydraulic fluid tank 31 via the SP operation valve 79 or the SP operation valve 80, the fluid-pressure extracting circuit 102, the supply line 103, the communication passage 111, the throttle 112, and the flow fluid passage 113.

Specifically, in the hydraulic circuit illustrated in FIG. 12D, for example, the SP operation valve 79, the SP operation valve 80, the fluid-pressure extracting circuit 102, the supply line 103, and the switching valve 84 constitute the return circuit 97.

In this modification, when the SP operation valve 79 or the SP operation valve 80 is to be opened during a heat-up operation, the pressure output from the SP operation valve 79 or the SP operation valve 80 is set so as to exceed zero and to be lower than a pressure value at which the SP control valve 94 is to be switched.

Figure 12E:
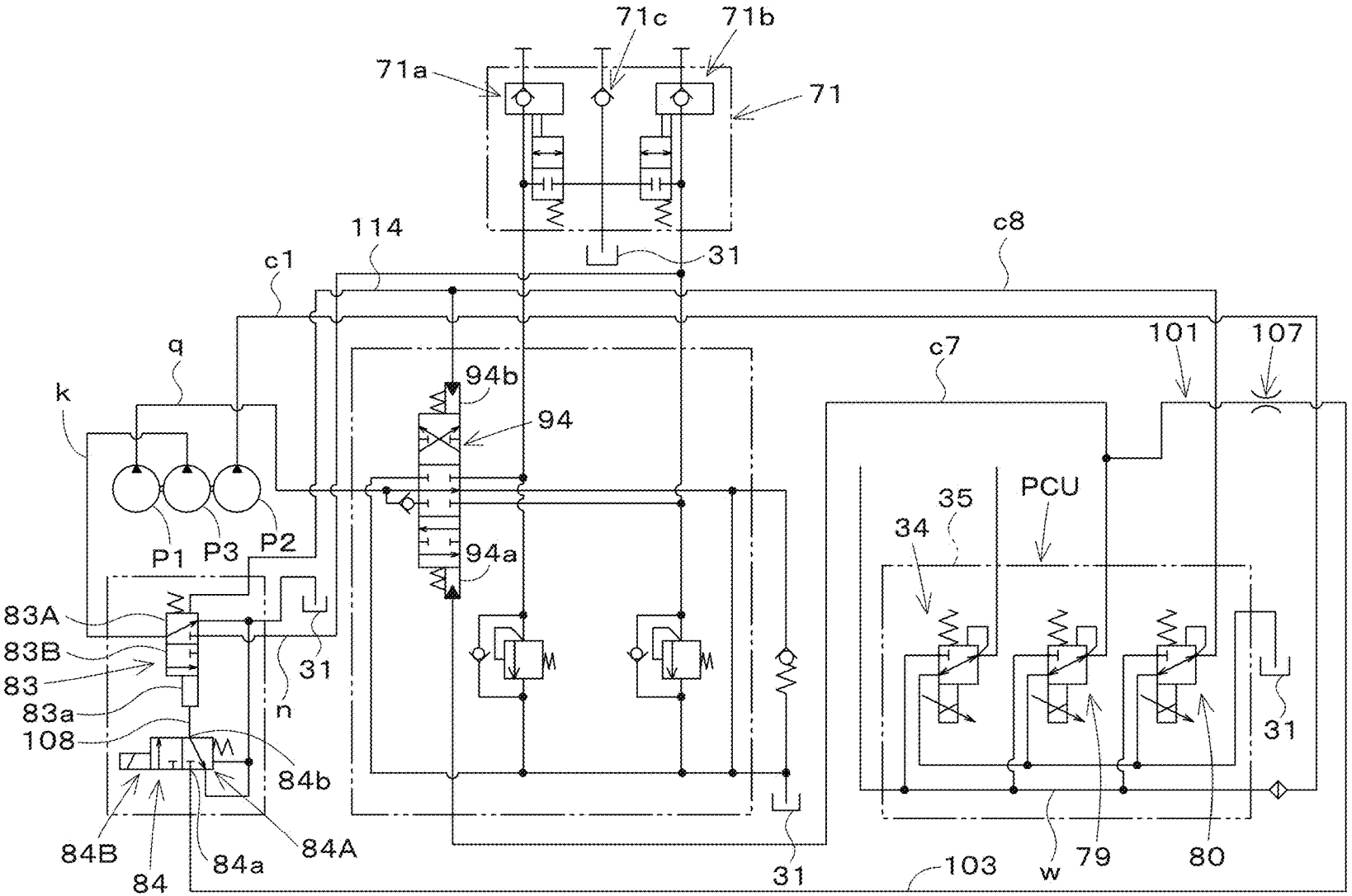
FIG. 12E illustrates a hydraulic circuit according to a modification of a hydraulic system according to a preferred embodiment of the present invention.

FIG. 12E illustrates a hydraulic circuit according to a modification of the hydraulic system.

With regard to the description of the hydraulic circuit illustrated in FIG. 12E, the differences from the hydraulic circuit illustrated in FIG. 12A will be described, whereas descriptions about identical components will be omitted.

In the hydraulic circuit illustrated in FIG. 12E, the high-flow switching circuit 101 does not have the fluid-pressure extracting circuit 102, and one end of the supply line 103 (i.e., the end opposite the end connected to the inlet port 84*a* of the switching valve 84) is connected to the seventh hydraulic fluid passage c7. Moreover, the high-flow switching circuit 101 has a fluid passage 114 that branches off from the eighth hydraulic fluid passage c8 and that connects to an end opposite the pressure receiver 83*a* of the high flow valve 83.

In the hydraulic circuit illustrated in FIG. 12E, when the SP operation valve (i.e., a proportional valve) 80 is open, the high flow valve 83 is forcedly switched to the non-increase position 83A, and the output fluid from the third pump P3 is not delivered to the increase fluid passage n. When the SP operation valve (i.e., a proportional valve) 79 is open, that is, when pressure is applied to the pressure receiver 94*a* of the SP control valve 94 and the pressure-fluid supply-and-drain joint 71*b* of the joint unit 71 is to be supplied with the hydraulic fluid from the first pump P1, the output fluid from the third pump P3 can be delivered to the increase fluid passage n.

Figure 12F:
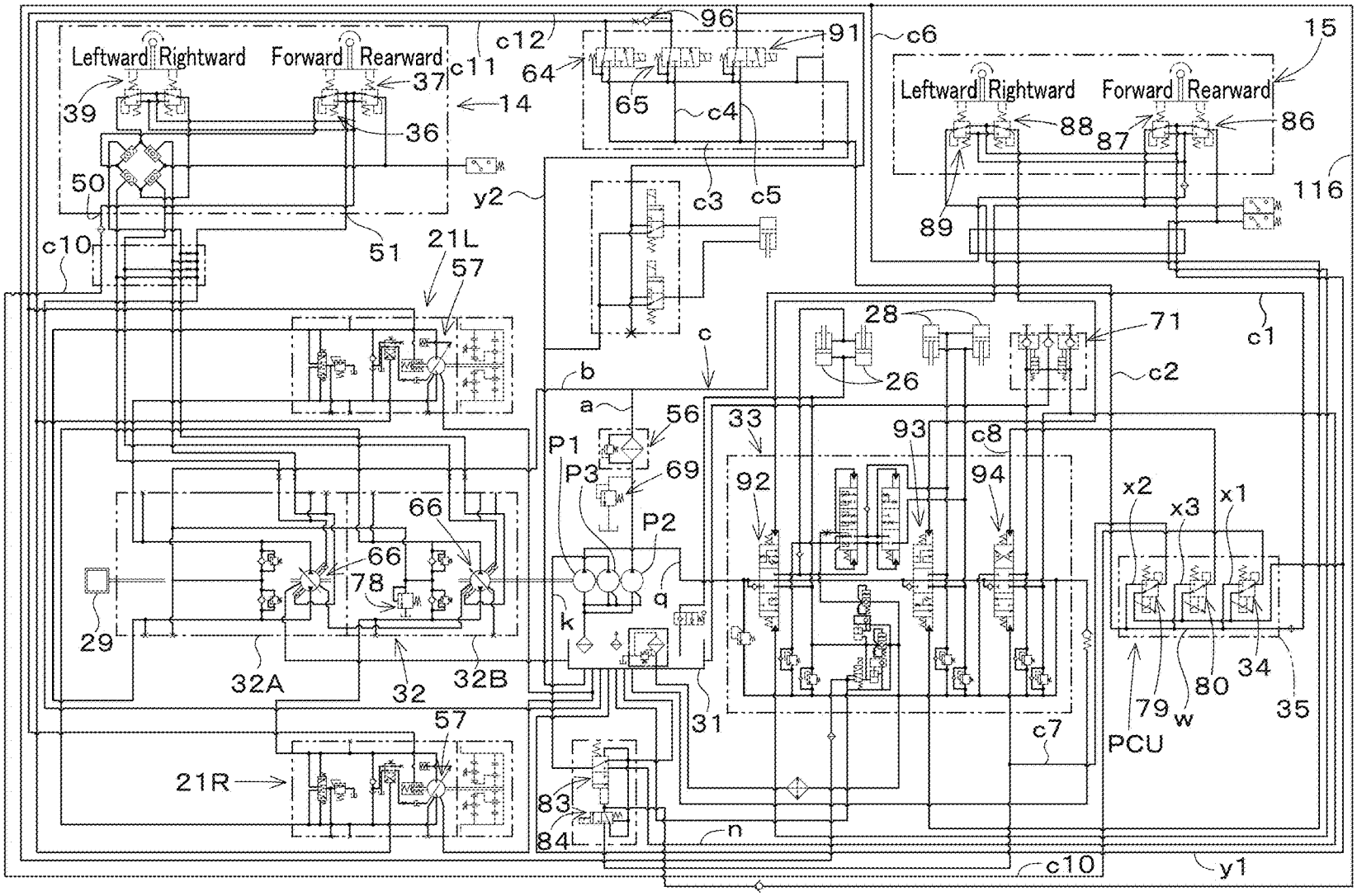
FIG. 12F illustrates a hydraulic circuit according to a modification of a hydraulic system according to a preferred embodiment of the present invention.
Figure 12G:
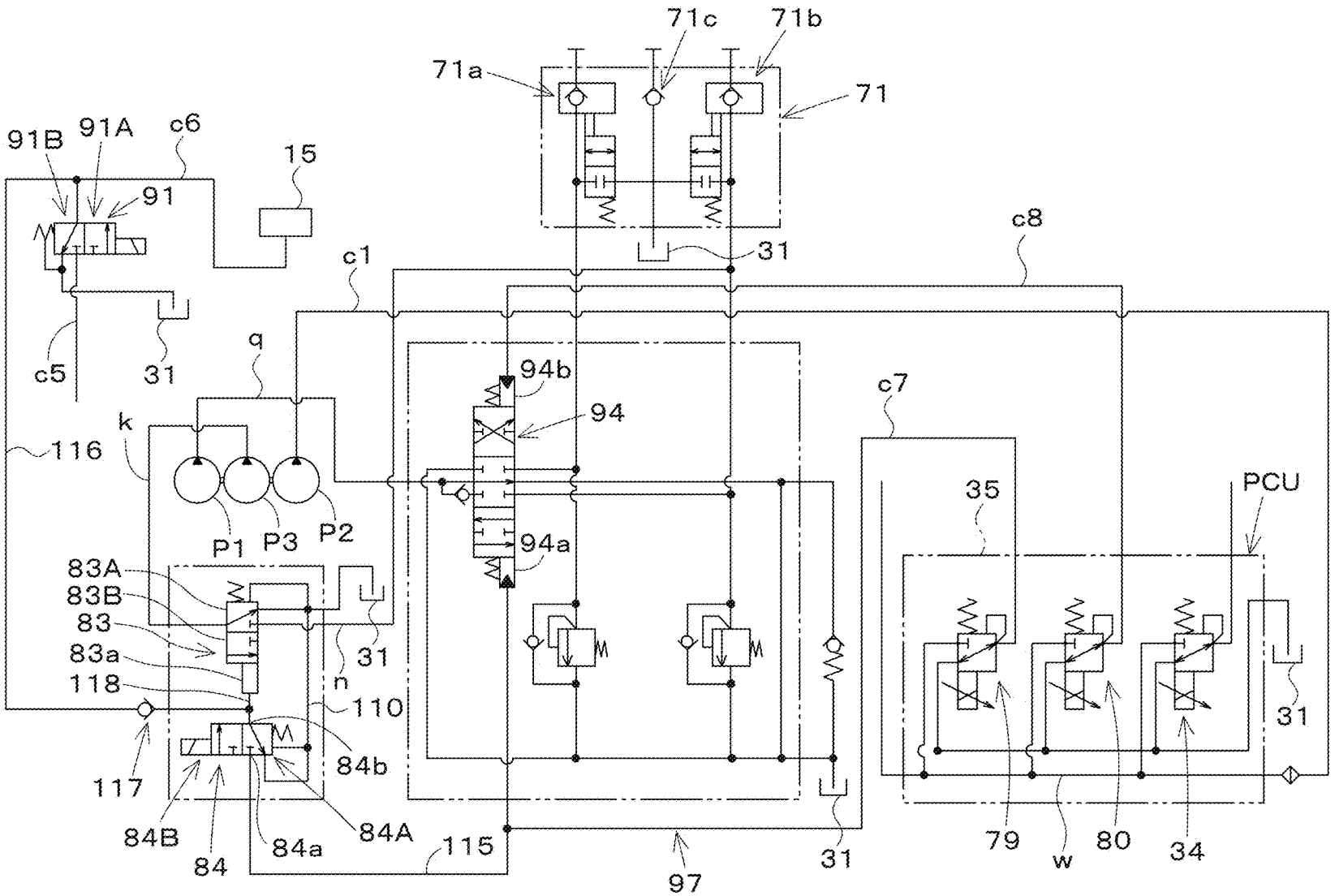
FIG. 12G illustrates a hydraulic circuit according to a modification of a hydraulic system according to a preferred embodiment of the present invention.

FIG. 12F and FIG. 12G illustrate a hydraulic circuit according to a modification of the hydraulic system.

With regard to the description of the hydraulic circuit illustrated in FIG. 12F and FIG. 12G, the differences from the hydraulic circuit illustrated in FIG. 1 and FIG. 12A will be described, whereas descriptions about identical components will be omitted.

In the hydraulic circuit illustrated in FIG. 12F and FIG. 12G, the SP operation valve 79 is disposed at a downstream-most location of the heat-up fluid passage w, and a branch fluid passage 115 branching off from the seventh hydraulic fluid passage c7 is connected to the inlet port 84*a* of the switching valve 84. The ninth hydraulic fluid passage c9 in FIG. 1 is not provided, and a branch fluid passage 116 branching off from the sixth hydraulic fluid passage c6 is connected to a fluid passage 118 between the outlet port 84*b* of the switching valve 84 and the pressure receiver 83*a* of the high flow valve 83. The branch fluid passage 116 is provided with a check valve 117 that prevents the hydraulic fluid from flowing from the sixth hydraulic fluid passage c6 toward the fluid passage 118.

In the hydraulic circuit illustrated in FIG. 12F and FIG. 12G, during a heat-up operation, the SP operation valve (i.e., a proportional valve) 79 is set to pressure low enough that the SP control valve 94 is not actuated, and the switching valve 84 is switched to the second position (i.e., open position) 84B, so that the hydraulic fluid flowing into the heat-up fluid passage w can be returned along the following path: SP operation valve 79 (at low pressure)→switching valve 84 (in open position 84B)→work lock valve 91 (in closed position 91B)→hydraulic fluid tank 31 (or inlet of second hydraulic pump P2). Accordingly, the fluid in the heat-up fluid passage w can be interchanged, so that the hydraulic fluid can be heated up.

When the heat-up operation is to be performed in this manner, the work lock valve 91 is set in the closed position 91B so that the working machine 1 is not actuated. When the heat-up operation is completed and the working machine 1 is to start operating, the work lock valve 91 is set in the open position 91A. In this state where the working machine 1 is to start operating, the supply of the pressure fluid from the sixth hydraulic fluid passage c6 to the fluid passage 118 is blocked by the check valve 117, so that the high flow valve 83 and the switching valve 84 can be actuated without any problems.

In the hydraulic circuit illustrated in FIG. 12F and FIG. 12G, for example, the SP operation valve 79, the seventh hydraulic fluid passage c7, the branch fluid passage 115, the switching valve 84, the fluid passage 118, the branch fluid passage 116, and the work lock valve 91 constitute the return circuit 97.

In all of the preferred embodiments described above, the return circuit 97 may directly return the hydraulic fluid to the inlet of the hydraulic pump (i.e., the second pump P2). In other words, the return circuit 97 may return the hydraulic fluid to the hydraulic fluid tank 31 or may return the hydraulic fluid to the inlet of the hydraulic pump.

Furthermore, in the preferred embodiments, each HST motor 57 is a swash-plate variable displacement axial motor, and the speed-changing mechanism that switches the HST motor 57 between the two high and low speed modes includes the swash-plate switching cylinder 58 that switches the swash plate of the HST motor 57 and the cylinder switching valve 63 that switches the swash-plate switching cylinder 58. However, since the HST motor 57 may sometimes be a hydraulic motor having a type of a speed-changing mechanism not equipped with a cylinder, such as a swash-plate switching cylinder, as in, for example, a radial piston motor, the hydraulic device to be supplied with the hydraulic fluid (i.e., a pilot fluid) from the second-speed switching valve 64 is not limited to the cylinder switching valve 63. In other words, the hydraulic device to be supplied with the hydraulic fluid from the second-speed switching valve 64 may simply be any speed-changing mechanism that switches the HST motor 57 between the two high and low speed modes.

The hydraulic system of the working machine according to this preferred embodiment includes a hydraulic pump (i.e., the second pump P2) to output a hydraulic fluid, at least one proportional valve (i.e., the traveling pressure control valve 34) to deliver the hydraulic fluid output from the hydraulic pump P2 to a supply target (i.e., the travel operation device 14), a valve body 35 that includes the proportional valve 34, a heat-up fluid passage w that is provided in the valve body 35 and into which the hydraulic fluid output from the hydraulic pump P2 flows, at least one switching valve (i.e., the second-speed switching valve 64, the brake release valve 65, the work lock valve 91) switchable between an open position 64A, 65A, 91A in which the hydraulic fluid having passed through the heat-up fluid passage w is supplied therethrough to a hydraulic device (i.e., the cylinder switching valve 63, the brake cylinder 59, the work operation device 15) and a closed position 64B, 65B, 91B in which the hydraulic fluid is not supplied therethrough to the hydraulic device 63, 59, 15 and the hydraulic fluid from the hydraulic device 63, 59, 15 is allowed to flow therethrough to be returned, a controller CU configured or programmed to operate the switching valve 64, 65, 91 and the proportional valve 34, and a return circuit 97 through which the hydraulic fluid having flown into the heat-up fluid passage w is returned as a result of at least one of the switching valve 64, 65, 91 and the proportional valve 34 being operated by the controller CU.

Accordingly, the hydraulic fluid flowing into the heat-up fluid passage w is returned as a result of at least one of the switching valve and the proportional valve 34 being operated by the controller CU, so that the discharge of the hydraulic fluid from within the heat-up fluid passage w can be reliably controlled.

Furthermore, the hydraulic system of the working machine may include a first hydraulic device (i.e., a hydraulic device corresponding to a first switching valve and being any one of the cylinder switching valve 63, the brake cylinder 59, and the work operation device 15) defining and functioning as a hydraulic device to be supplied with the hydraulic fluid via the first switching valve of a plurality of switching valves including the first switching valve (i.e., any one of the second-speed switching valve 64, the brake release valve 65, and the work lock valve 91) and a second switching valve (i.e., any remaining one of the second-speed switching valve 64, the brake release valve 65, and the work lock valve 91 other than the first switching valve), a first fluid passage (i.e., a hydraulic-device fluid passage corresponding to the first hydraulic device and the first switching valve and being any one of the eleventh hydraulic fluid passage c11, the twelfth hydraulic fluid passage c12, and the sixth hydraulic fluid passage c6) that connects the first hydraulic device and the first switching valve to each other, a second hydraulic device (i.e., a hydraulic device corresponding to the second switching valve and being any one of the cylinder switching valve 63, the brake cylinder 59, and the work operation device 15) defining and functioning as a hydraulic device to be supplied with the hydraulic fluid via the second switching valve, and a second fluid passage (i.e., a hydraulic-device fluid passage corresponding to the second hydraulic device and the second switching valve and being any one of the eleventh hydraulic fluid passage c11, the twelfth hydraulic fluid passage c12, and the sixth hydraulic fluid passage c6) that connects the second hydraulic device and the second switching valve to each other. The return circuit 97 may include the connection circuit 96 that connects the first fluid passage and the second fluid passage to each other, and may return the hydraulic fluid from the heat-up fluid passage w to the hydraulic fluid tank 31 via the first fluid passage, the connection circuit 96, the second fluid passage, and the second switching valve as a result of the first switching valve being operated to the open position by the controller CU in a state where the second switching valve is in the closed position.

Furthermore, the hydraulic system of the working machine may include the second-speed switching valve 64 to switch the traveling devices 4, which are speed-changeable between two high and low speed modes, to the second speed mode, the brake release valve 65 to release a braking force applied to the traveling devices 4, and the work lock valve 91 to set the work operation device 15, which operates the working device 3, in a non-operable mode. The first switching valve may be any one of the second-speed switching valve 64, the brake release valve 65, and the work lock valve 91. The second switching valve may be any remaining one of the second-speed switching valve 64, the brake release valve 65, and the work lock valve 91 other than the first switching valve.

Furthermore, the hydraulic system of the working machine may include a supply fluid passage (i.e., the tenth hydraulic fluid passage c10) to supply the hydraulic fluid from the proportional valve 34 to the supply target (i.e., the travel operation device 14). The proportional valve (i.e., the traveling pressure control valve 34), when opened to have an opening adjusted for setting a set pressure of the proportional valve, may output the hydraulic fluid having the set pressure to the supply target 14, and, when closed, may allow the hydraulic fluid from the supply fluid passage c10 to flow therethrough to be returned. The return circuit 97 may include the connection circuit 96 that connects the supply fluid passage c10 to a hydraulic-device fluid passage (i.e., the eleventh hydraulic fluid passage c11, the twelfth hydraulic fluid passage c12, the sixth hydraulic fluid passage c6) to supply the hydraulic fluid from a switching valve (i.e., the second-speed switching valve 64, the brake release valve 65, the work lock valve 91) to a hydraulic device (i.e., the cylinder switching valve 63, the brake cylinder 59, the work operation device 15). The hydraulic fluid from the heat-up fluid passage w may be returned through the return circuit 97 via the hydraulic-device fluid passage, the connection circuit 96, the supply fluid passage c10, and the proportional valve 34 as a result of the switching valve being operated to the open position by the controller CU in a state where the proportional valve 34 is closed.

Furthermore, a set pressure of the switching valve (i.e., the second-speed switching valve 64, the brake release valve 65, the work lock valve 91) may be higher than the set pressure of the proportional valve 34.

Furthermore, the hydraulic system of the working machine may include a supply fluid passage (i.e., the tenth hydraulic fluid passage c10) to supply the hydraulic fluid flowing through the heat-up fluid passage w from the proportional valve (i.e., the traveling pressure control valve 34) to the supply target (i.e., the travel operation device 14). The proportional valve 34, when opened to have an opening adjusted for setting a set pressure of the proportional valve 34, may output the hydraulic fluid having the set pressure to the supply target 14, and, when closed, may allow the hydraulic fluid from the supply fluid passage (i.e., the tenth hydraulic fluid passage c10) to flow therethrough to be returned. The return circuit 97 may include the connection circuit 96 that connects the supply fluid passage c10 to a hydraulic-device fluid passage (i.e., the eleventh hydraulic fluid passage c11, the twelfth hydraulic fluid passage c12, the sixth hydraulic fluid passage c6) to supply the hydraulic fluid from a switching valve (i.e., the second-speed switching valve 64, the brake release valve 65, the work lock valve 91) to a hydraulic device (i.e., the cylinder switching valve 63, the brake cylinder 59, the work operation device 15). The hydraulic fluid flowing in from the heat-up fluid passage w may be returned through the return circuit 97 via the proportional valve 34, the supply fluid passage c10, the connection circuit 96, the hydraulic-device fluid passage, and the switching valve as a result of the proportional valve 34 being opened by the controller CU in a state where the switching valve is in the closed position.

Furthermore, the set pressure of the proportional valve 34 may be higher than a set pressure of the switching valve (i.e., the second-speed switching valve 64, the brake release valve 65, the work lock valve 91).

Furthermore, the hydraulic system of the working machine may include a third hydraulic device (i.e., a hydraulic device corresponding to a third switching valve and being any one of the cylinder switching valve 63, the brake cylinder 59, and the work operation device 15) defining the hydraulic device to be supplied with the hydraulic fluid via the third switching valve of a plurality of the switching valves including the third switching valve (i.e., any one of the second-speed switching valve 64, the brake release valve 65, and the work lock valve 91) and a fourth switching valve (i.e., any remaining one of the second-speed switching valve 64, the brake release valve 65, and the work lock valve 91 other than the third switching valve), a third fluid passage (i.e., a fluid passage corresponding to the third hydraulic device and the third switching valve and being any one of the eleventh hydraulic fluid passage c11, the twelfth hydraulic fluid passage c12, and the sixth hydraulic fluid passage c6) that connects the third hydraulic device and the third switching valve to each other, a fourth hydraulic device (i.e., a hydraulic device corresponding to the fourth switching valve and being any one of the cylinder switching valve 63, the brake cylinder 59, and the work operation device 15) defining the hydraulic device to be supplied with the hydraulic fluid via the fourth switching valve, a fourth fluid passage (i.e., a fluid passage corresponding to the fourth hydraulic device and the fourth switching valve and being any one of the eleventh hydraulic fluid passage c11, the twelfth hydraulic fluid passage c12, and the sixth hydraulic fluid passage c6) that connects the fourth hydraulic device and the fourth switching valve to each other, and a supply fluid passage (i.e., the tenth hydraulic fluid passage c10) to supply the hydraulic fluid flowing through the heat-up fluid passage w from the proportional valve 34 to the supply target 14. The proportional valve 34, when opened to have an opening adjusted to set a set pressure of the proportional valve, may output the hydraulic fluid having the set pressure to the supply target 14, and, when closed, may allow the hydraulic fluid from the supply fluid passage c10 to flow therethrough to be returned. The return circuit 97 may include the bleed circuit 100 that is connected to the third fluid passage and through which the hydraulic fluid from the heat-up fluid passage w is returned from the third fluid passage via the throttle 99, and may also have the connection circuit 96 that connects the fourth fluid passage and the supply fluid passage to each other. The hydraulic fluid having flown into the heat-up fluid passage w may be returned through the return circuit 97 via the bleed circuit 100, the proportional valve 34, the supply fluid passage, the connection circuit 96, the fourth fluid passage, and the fourth switching valve as a result of the third switching valve being operated to the open position by the controller CU and the proportional valve 34 being opened by the controller CU in a state where the fourth switching valve is in the closed position.

Furthermore, the set pressure of the proportional valve 34 may be higher than a set pressure of the fourth switching valve.

Furthermore, the proportional valve may include a plurality of proportional valves. The plurality of proportional valves 34, 79, and 80 may be arranged in sequence from upstream toward downstream of the heat-up fluid passage w and may each be supplied with the hydraulic fluid from the heat-up fluid passage w. The proportional valve 34 to supply the hydraulic fluid to the supply target (i.e., the travel operation device 14) through the supply fluid passage (i.e., the tenth hydraulic fluid passage c10) may be located at a downstream-most location of the heat-up fluid passage w.

Furthermore, the hydraulic system of the working machine may include the traveling devices 4, the hydraulic driving device 32 to hydraulically drive the traveling devices 4, and the travel operation device 14 to pilot-operate the hydraulic driving device 32. The proportional valve may be the traveling pressure control valve 34 to supply the hydraulic fluid to the travel operation device 14 defining and functioning as the supply target.

Furthermore, the return circuit 97 may include the bleed circuit 100 that is connected to a hydraulic-device fluid passage (i.e., the eleventh hydraulic fluid passage c11, the twelfth hydraulic fluid passage c12, the sixth hydraulic fluid passage c6) to supply the hydraulic fluid to the hydraulic device (i.e., the cylinder switching valve 63, the brake cylinder 59, the work operation device 15) from the switching valve (i.e., the second-speed switching valve 64, the brake release valve 65, the work lock valve 91) and through which the hydraulic fluid is returned from the hydraulic-device fluid passage via the throttle 99 as a result of the switching valve being operated to the open position by the controller CU.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hydraulic system of a working machine, comprising:

a hydraulic pump to output a hydraulic fluid;

at least one proportional valve to deliver the hydraulic fluid output from the hydraulic pump to a supply target;

a valve body that includes the proportional valve;

a heat-up fluid passage that is provided in the valve body and into which the hydraulic fluid output from the hydraulic pump flows;

at least one switching valve switchable between an open position in which the hydraulic fluid having passed through the heat-up fluid passage is supplied therethrough to a hydraulic device and a closed position in which the hydraulic fluid having passed through the heat-up fluid passage is not supplied therethrough to the hydraulic device and the hydraulic fluid from the hydraulic device is allowed to flow therethrough to be returned;

a controller configured or programmed to operate the switching valve and the proportional valve; and a return circuit through which the hydraulic fluid having flown into the heat-up fluid passage is returned as a result of at least one of the switching valve and the proportional valve being operated by the controller.

2. The hydraulic system of the working machine according to claim 1, further comprising:

a first hydraulic device defining the hydraulic device to be supplied with the hydraulic fluid via a first switching valve of a plurality of the switching valves including the first switching valve and a second switching valve;

a first fluid passage that connects the first hydraulic device and the first switching valve to each other;

a second hydraulic device defining the hydraulic device to be supplied with the hydraulic fluid via the second switching valve; and a second fluid passage that connects the second hydraulic device and the second switching valve to each other; wherein the return circuit includes a connection circuit that connects the first fluid passage and the second fluid passage to each other; and the hydraulic fluid from the heat-up fluid passage is returned through the return circuit via the first fluid passage, the connection circuit, the second fluid passage, and the second switching valve as a result of the first switching valve being operated to the open position by the controller in a state where the second switching valve is in the closed position.

3. The hydraulic system of the working machine according to claim 2, further comprising:

a second-speed switching valve to switch a traveling device to a second speed mode, the traveling device being speed-changeable between two high and low speed modes;

a brake release valve to release a braking force applied to the traveling device; and a work lock valve to set a work operation device in a non-operable mode, the work operation device operating a working device; wherein the first switching valve is any one of the second-speed switching valve, the brake release valve, and the work lock valve; and the second switching valve is any remaining one of the second-speed switching valve, the brake release valve, and the work lock valve other than the first switching valve.

4. The hydraulic system of the working machine according to claim 1, further comprising:

a supply fluid passage to supply the hydraulic fluid from the proportional valve to the supply target; wherein the proportional valve is operable to, when opened to have an opening adjusted for setting a set pressure of the proportional valve, output the hydraulic fluid having the set pressure to the supply target, and, when closed, allow the hydraulic fluid from the supply fluid passage to flow therethrough to be returned;

the return circuit includes a connection circuit that connects the supply fluid passage to a hydraulic-device fluid passage to supply the hydraulic fluid from the switching valve to the hydraulic device; and the hydraulic fluid from the heat-up fluid passage is returned through the return circuit via the hydraulic-device fluid passage, the connection circuit, the supply fluid passage, and the proportional valve as a result of the switching valve being operated to the open position by the controller in a state where the proportional valve is closed.

5. The hydraulic system of the working machine according to claim 4, wherein a set pressure of the switching valve is higher than the set pressure of the proportional valve.

6. The hydraulic system of the working machine according to claim 1, further comprising:

a supply fluid passage to supply the hydraulic fluid flowing through the heat-up fluid passage from the proportional valve to the supply target; wherein the proportional valve is operable to, when opened to have an opening adjusted for setting a set pressure of the proportional valve, output the hydraulic fluid having the set pressure to the supply target, and, when closed, allow the hydraulic fluid from the supply fluid passage to flow therethrough to be returned;

the return circuit includes a connection circuit that connects the supply fluid passage to a hydraulic-device fluid passage to supply the hydraulic fluid from the switching valve to the hydraulic device; and the hydraulic fluid flowing in from the heat-up fluid passage is returned through the return circuit via the proportional valve, the supply fluid passage, the connection circuit, the hydraulic-device fluid passage, and the switching valve as a result of the proportional valve being opened by the controller in a state where the switching valve is in the closed position.

7. The hydraulic system of the working machine according to claim 6, wherein the set pressure of the proportional valve is higher than a set pressure of the switching valve.

8. The hydraulic system of the working machine according to claim 1, further comprising:

a third hydraulic device defining the hydraulic device to be supplied with the hydraulic fluid via a third switching valve of a plurality of the switching valves including the third switching valve and a fourth switching valve;

a third fluid passage that connects the third hydraulic device and the third switching valve to each other;

a fourth hydraulic device defining the hydraulic device to be supplied with the hydraulic fluid via the fourth switching valve;

a fourth fluid passage that connects the fourth hydraulic device and the fourth switching valve to each other; and a supply fluid passage to supply the hydraulic fluid flowing through the heat-up fluid passage from the proportional valve to the supply target; wherein the proportional valve is operable to, when opened to have an opening adjusted for setting a set pressure of the proportional valve, output the hydraulic fluid having the set pressure to the supply target, and, when closed, allow the hydraulic fluid from the supply fluid passage to flow therethrough to be returned;

the return circuit includes:

a bleed circuit that is connected to the third fluid passage and through which the hydraulic fluid from the heat-up fluid passage is returned from the third fluid passage via a throttle; and a connection circuit that connects the fourth fluid passage and the supply fluid passage to each other; and the hydraulic fluid having flown into the heat-up fluid passage is returned through the return circuit via the bleed circuit, the proportional valve, the supply fluid passage, the connection circuit, the fourth fluid passage, and the fourth switching valve as a result of the third switching valve being operated by the controller to the open position and the proportional valve being opened by the controller in a state where the fourth switching valve is in the closed position.

9. The hydraulic system of the working machine according to claim 8, wherein the set pressure of the proportional valve is higher than a set pressure of the fourth switching valve.

10. The hydraulic system of the working machine according to claim 6, wherein the at least one proportional valve includes a plurality of proportional valves;

the plurality of proportional valves are arranged in sequence from upstream toward downstream of the heat-up fluid passage and are each supplied with the hydraulic fluid from the heat-up fluid passage; and the proportional valve to supply the hydraulic fluid to the supply target through the supply fluid passage is at a downstream-most location of the heat-up fluid passage.

11. The hydraulic system of the working machine according to claim 4, further comprising:

a traveling device;

a hydraulic driving device to hydraulically drive the traveling device; and a travel operation device to pilot-operate the hydraulic driving device; wherein the proportional valve is a traveling pressure control valve to supply the hydraulic fluid to the travel operation device defining the supply target.

12. The hydraulic system of the working machine according to claim 1, wherein the return circuit includes a bleed circuit that is connected to a hydraulic-device fluid passage to supply the hydraulic fluid to the hydraulic device from the switching valve and through which the hydraulic fluid is returned from the hydraulic-device fluid passage via a throttle as a result of the switching valve being operated to the open position by the controller.

* * * * *